US009339095B2

(12) United States Patent
Kodama

(10) Patent No.: US 9,339,095 B2
(45) Date of Patent: May 17, 2016

(54) HIGHLIGHT APPLICATOR

(71) Applicant: KAO CORPORATION, Tokyo (JP)

(72) Inventor: Daisuke Kodama, Loveland, OH (US)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 14/179,829

(22) Filed: Feb. 13, 2014

(65) Prior Publication Data

US 2014/0261519 A1 Sep. 18, 2014

Related U.S. Application Data

(60) Provisional application No. 61/789,726, filed on Mar. 15, 2013.

(51) Int. Cl.

| | |
|---|---|
| ***A45D 24/30*** | (2006.01) |
| ***A45D 19/02*** | (2006.01) |
| ***A45D 19/00*** | (2006.01) |
| *A45D 7/00* | (2006.01) |

(52) U.S. Cl.

CPC ..... *A45D 19/02* (2013.01); *A45D 19/0008* (2013.01); *A45D 2007/001* (2013.01)

(58) Field of Classification Search

CPC ... A45D 19/02; A45D 19/00; A45D 19/0008; A45D 2019/025; A45D 2019/0041; A45D 2019/005; A45D 19/0066; A45D 2019/0083; A45D 2019/0091; A45D 24/22; A45D 2200/25; A45D 2200/00; A45D 2200/10; A45D 2007/001; A45D 8/12; A45D 8/34; A45D 8/36; A45D 8/20; A45D 8/24; A45D 8/00; A46B 2200/104; A46B 2200/1046; A46B 2200/00; A46B 5/0025; A46B 5/0029; A46B 5/0033; A46B 5/0037; A46B 15/00; A46B 9/023; A46B 9/028; A46B 7/02; A46B 7/023; A46B 7/026; A01K 13/00; A01K 13/001; A01K 13/002; A01K 13/003

USPC ..... 132/107, 200, 202, 207, 208, 203, 212, 132/108, 109, 114, 120, 150, 151, 159, 162, 132/313, 317, 320, 901, 273, 276, 136, 116

See application file for complete search history.

(56) References Cited

U.S. PATENT DOCUMENTS

| | | | | | |
|---|---|---|---|---|---|
| 621,705 | A | * | 3/1899 | Rasnick | 132/281 |
| 1,002,942 | A | * | 9/1911 | Taylor | 132/117 |
| 1,233,956 | A | * | 7/1917 | Anderson | 132/136 |
| 1,501,089 | A | * | 7/1924 | Andrews | 401/28 |
| 2,672,875 | A | * | 3/1954 | Kovaes | 132/112 |
| 2,705,499 | A | * | 4/1955 | Breeze | 132/109 |
| 3,288,115 | A | | 11/1966 | Hechtle | |
| 3,886,619 | A | * | 6/1975 | Natman et al. | 15/187 |
| 4,423,531 | A | * | 1/1984 | Wall | 15/187 |
| 4,475,563 | A | * | 10/1984 | Martin | 132/136 |
| 4,500,939 | A | * | 2/1985 | Gueret | 361/221 |

(Continued)

*Primary Examiner* — Rachel Steitz

(74) *Attorney, Agent, or Firm* — Frost Brown Todd LLC

(57) ABSTRACT

A hair applicator comprises a body, a flexible member, and a means of transferring a center of the flexible member. The flexible member comprises bristles, which may be arranged in a circular pattern and/or of differing lengths. A user applies an appropriate amount of hair coloring composition within the bristles of the flexible member. When the center of the flexible member is moved, the shape of the flexible member is changed which causes the bristles to form a conical shape which may be used to grasp strands of hair. The user combs the hair coloring composition throughout the length of the hair to effectively highlight the desired hair strands.

25 Claims, 33 Drawing Sheets

(56) References Cited

U.S. PATENT DOCUMENTS

| | | | | |
|---|---|---|---|---|
| 4,991,988 | A | 2/1991 | Snell et al. | |
| 5,305,767 | A * | 4/1994 | Ivanov | 132/151 |
| 5,333,627 | A * | 8/1994 | Mehringer et al. | 132/108 |
| 5,449,007 | A * | 9/1995 | Arnhols | 132/136 |
| 5,937,866 | A * | 8/1999 | Magharehi | 132/116 |
| 6,006,395 | A * | 12/1999 | Tiramani et al. | 15/176.1 |
| 6,062,231 | A * | 5/2000 | De Laforcade | 132/145 |
| 6,196,235 | B1 * | 3/2001 | Kim | 132/148 |
| 6,279,582 | B1 * | 8/2001 | Wang | 132/154 |
| 6,453,909 | B1 * | 9/2002 | De Laforcade | 132/208 |
| 6,574,915 | B1 * | 6/2003 | Allen | 43/134 |
| 7,389,779 | B2 * | 6/2008 | Chan | 132/136 |
| 7,981,094 | B2 | 7/2011 | Chelak | |
| 8,056,568 | B2 * | 11/2011 | Ruckart | 132/136 |
| 8,528,573 | B2 * | 9/2013 | Chudzik et al. | 132/276 |
| 8,955,525 | B2 * | 2/2015 | Tiram | 132/112 |
| 2007/0144550 | A1 * | 6/2007 | Roher | 132/208 |
| 2008/0053473 | A1 * | 3/2008 | Lee | 132/313 |
| 2008/0087292 | A1 * | 4/2008 | Abergel et al. | 132/208 |
| 2008/0223391 | A1 * | 9/2008 | Baker et al. | 132/202 |
| 2010/0101595 | A1 * | 4/2010 | Glenn et al. | 132/208 |
| 2014/0096786 | A1 * | 4/2014 | Nuzzo et al. | 132/207 |

* cited by examiner

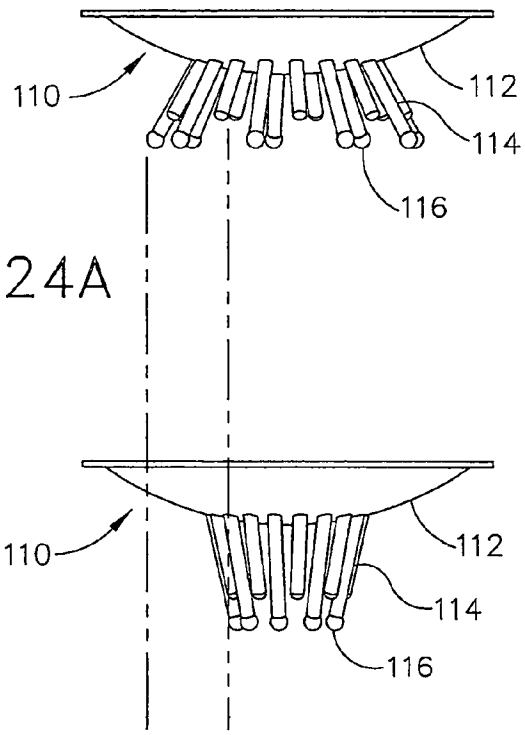
Fig.24A
Fig.24B
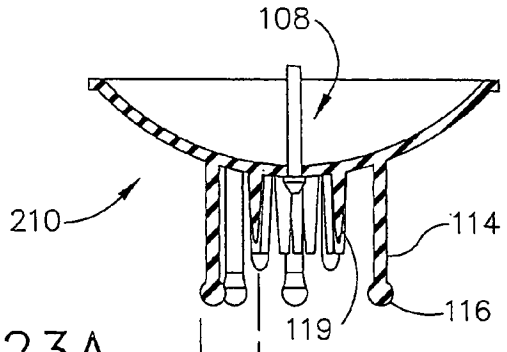
Fig.23A
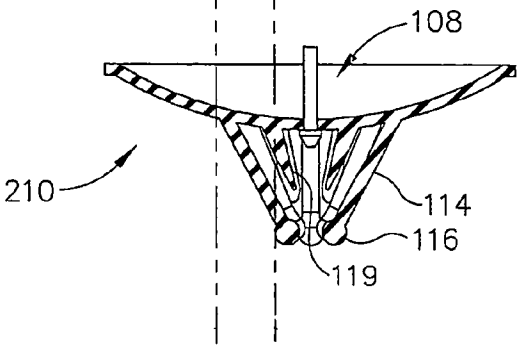
Fig.23B

HIGHLIGHT APPLICATOR

This application is based on and claims priority from U.S. Provisional Patent Application No. 61/789,726, filed Mar. 15, 2013, which is incorporated herein by reference.

BACKGROUND

Today's consumer desires to have a personalized appearance which includes a consumer's hair. Many consumers prefer to have hair coloration reflect an appearance of younger age. Also, regardless of age, consumers often want to experiment with hair shades different than their natural color. A variety of hair colors and bleaches may be used in salons and at home to achieve a plurality of effects on a consumer's hair color. Therefore, a wealth of hair care products exists to vary hair color, and lighten selected strands. The selected coloration may be used to accent certain hair styles and subsequently the overall appearance of a consumer. Often this is achieved by multi-tonal or contrasting effect of the hair color.

In practical terms, achieving multi-tonal effects may involve dyeing and highlighting hair. Hair dyeing or bleaching which may involve altering the overall color of the hair, usually requires application of a hair dye or bleach for a period of time followed by a rinse to remove the dye or bleach. During highlighting, the color of groups of selected hair strands may be altered to provide a multi-tonal or contrasting effect which creates a desirable appearance and gives the hair an illusion of volume. For example, a highlighter, a hair bleach, or a hair dye may be applied to portions or strands of the hair to achieve a lightening of those portions.

Multi-tonal effects may be provided in a salon. In the salon, strands may be segregated for highlighting before an overall color is applied. The labor intensive nature of multi-tonal effects usually renders a relatively expensive salon treatment. Home dye treatments are a less expensive alternative to salon treatments. However, home dye treatments may result in a look that is drastic in that the hair becomes substantially a single color all over with very few shade distinctions. Similarly, home highlighting kits are difficult and imprecise to use and may result in a relatively drastic lightening of the hair or may provide unnatural effects. This is because dyeing and highlighting are particularly difficult to be executed satisfactorily without assistance. These applications, in view of the relatively irreversible effects they product, must occur carefully and precisely.

In order to prevent such drastic results in home dye treatments, hair treatment applicators have been developed to allow a user to apply a hair product more precisely and evenly from root to tip without assistance. These applicators range from cap and hook type devices, brushes, wands, clips, combs, and fingertip applicator like devices, which are either supplied separately or are designed to be attached to the hair treatment composition bottle. None of these known applicators are particularly satisfactory. The cap and hook method requires the consumer to place an aperture cap over the hair and then to select and move hair strands which are to be subjected to the hair treatment through the apertures with a hook. Such an application is not easy to manage, especially unassisted. Home highlighting kits frequently do not include foils and therefore cannot be used effectively to create the multi-tonal look. The foils used by professionals protect the rest of the hair from color bleeding, by folding the colored strand of hair inside the foil once the color is applied. But for a home user it is quite difficult and time consuming to attach and fold foils, especially in the back of the head. Without the use of foils in the home highlighting kits, the different shades of color bleed over from the one colored strand to another colored strand, with unattractive and unintended results.

The brushes, wand, clips, combs, and fingertip applicator devices may require the consumer to load the device with the hair product and then apply the hair product along the length of a selected hair strand, reloading as required. The comb devices may have a chamber to load a predetermined quantity of the hair product. The comb and bottle devices may require simultaneous squeezing of the bottle to release the treatment composition while combing the hair. These applicators require the consumer to personally determine the width of the hair strand to be treated and to separate it from the rest of the hair. Alternatively, only a predetermined strand width selection can be treated and strand separation is not required, thus precluding any variation. Finally, it is highly undesirable that any contamination of the untreated remaining hair with the self-applied hair treatment composition occurs.

Also, current applicators may not provide consumers with the ability to control the width of the hair strand to which hair coloration product is being applied. If such control is provided, the applicator may not provide the consumer with the ability to reproduce such a desirable width consistently, and as such, hair strands of varying widths will be dyed or highlighted.

While some consumers may be reasonably satisfied with the end result achieved with the currently available products, due to the time and effort required as well as the inconsistent results, many consumers still want a better home product to supplement the services offered by professional hair salon stylists in order to attain the desired result.

It is important to note that consumers may desire to apply many other hair styling products, including those not associates with dyeing or coloring hair, where a particular style or benefit is needed or desired on a segmented section of the hair. For instance, some consumers may wish to bleach the hair or some may desire to create a temporary effect, such as a glitter, on a desired segment of hair. Also, some consumers may desire to apply a styling product or conditioner, among many other hair products, on a desired segment of hair.

While several systems and methods have been made and used for applying hair product, it is believed that no one prior to the inventor(s) has made or used the invention described in the present application.

BRIEF DESCRIPTION OF THE DRAWING

It is believed the present invention will be better understood from the following description of certain examples taken in conjunction with the accompanying drawings, in which like reference numerals identify the same elements and in which:

FIG. 1 OA depicts a bottom view of a bristle configuration having an elliptical pattern of the exemplary highlight applicator of FIG. 1;

FIG. 23A depicts a cross-sectional side view of the alternative flexible bristle member of FIG. 21 in an open position;

FIG. 23B depicts a cross-sectional side view of the alternative flexible bristle member of FIG. 21 in a closed position, with a representation of the required travel to close the bristles;

FIG. 24A depicts a cross-sectional side view of the alternative flexible bristle member of FIG. 6A in an open position;

FIG. 24B depicts a cross-sectional side view of the alternative flexible bristle member of FIG. 6A in a closed position, with a representation of the required travel to close the bristles;

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention.

Accordingly, the drawings and descriptions should be regarded as illustrative in nature and not restrictive.

I. Exemplary Highlight Applicator

Figure 1:
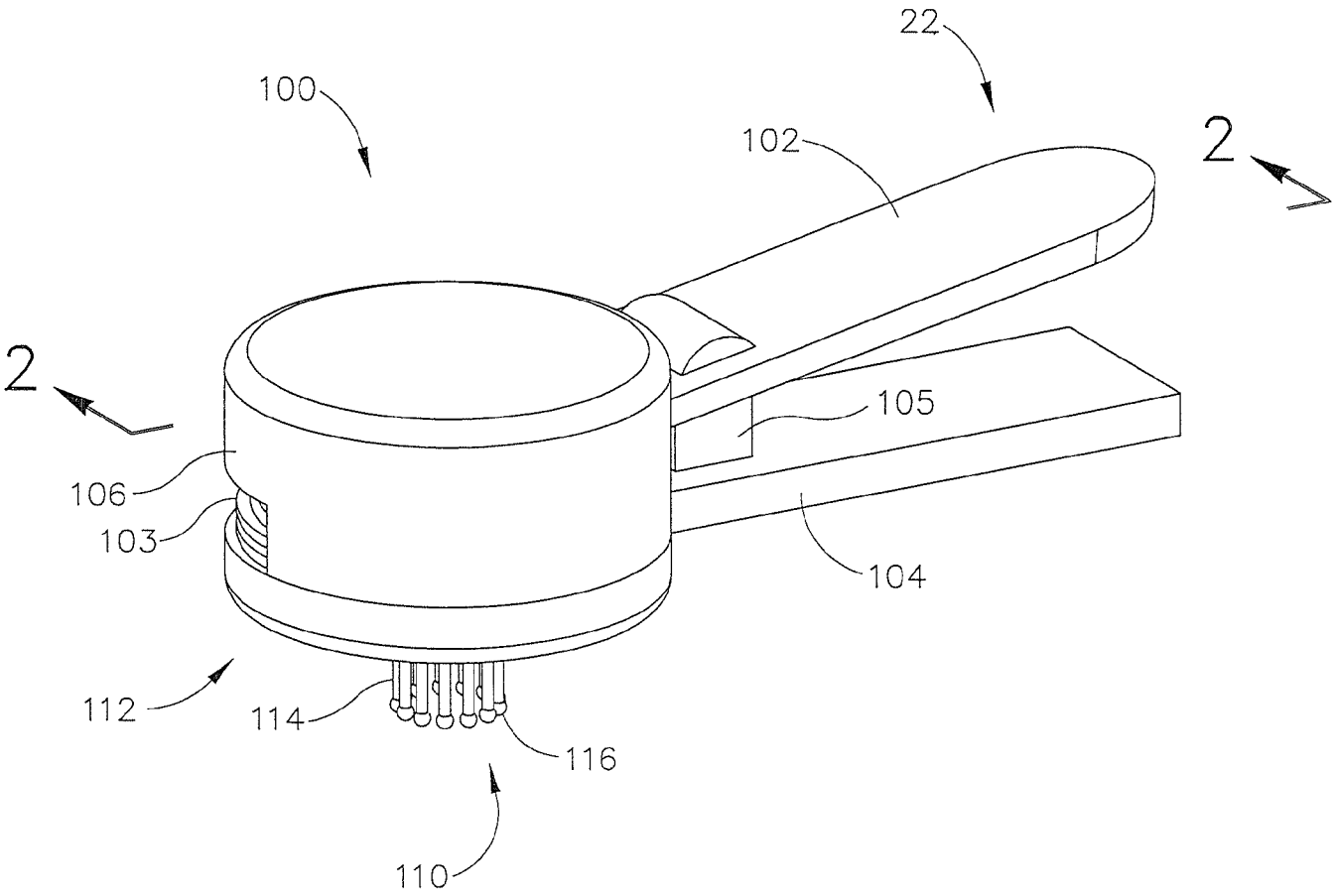
FIG. 1 depicts a perspective view of an exemplary highlight applicator.
Figure 2A:
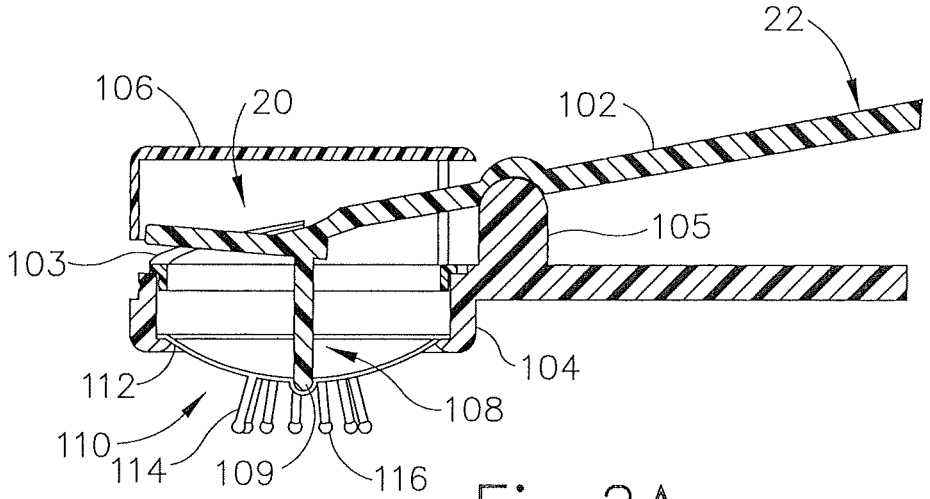
FIG. 2A depicts a cross-sectional side view, taken along line 2-2 of FIG. 1, of the highlight applicator of FIG. 1, in an open position.
Figure 2B:
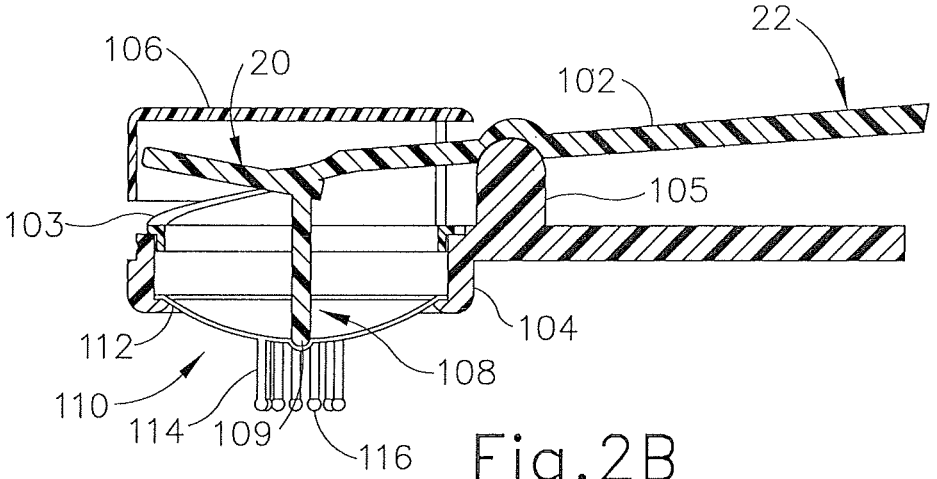
FIG. 2B depicts a cross-sectional side view, taken along line 2-2 of FIG. 1, of the highlight applicator of FIG. 1, in a transitional position.
Figure 2C:
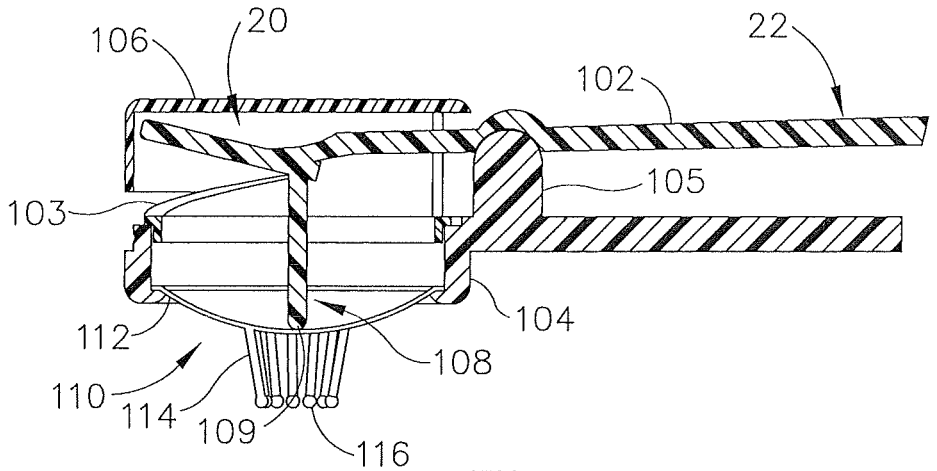
FIG. 2C depicts a cross-sectional side view, taken along line 2-2 of FIG. 1, of the highlight applicator of FIG. 1, in a closed position.

As shown in FIGS. 1-2C, an exemplary highlight applicator (100) includes a body (104), a lever (102), a cap (106), an adjuster (103), and a flexible bristle member (110). Lever (102) comprises a proximal end (20) and a distal end (22). Lever (102) may be coupled with flexible bristle member (110) at proximal end (20) of lever (102) using a flexible connector (108), but may be coupled with lever (102) by any other means. (Flexible connector (108) may be, for example, a flexible rod or a spring). Flexible connector (108) may necessarily comprise a tip(s) (109) to prevent flexible connector (108) from being decoupled from the lever (102) or flexible bristle member (110). As will be discussed below, flexible connector (108) may be a separate piece or may be integrally coupled with the level (102) or flexible bristle member (110). Flexible bristle member (110) of the present example comprises a disc (112) and a plurality of bristles (114) attached to disc (112). The bristles (114) are attached to disc (112) while bristles (114) are spread outwardly and disc (112) has a figure of a partial sphere. Prior to assembly, disc (112) of flexible bristle member (110) is in a predetermined shape.

Figure 3A:
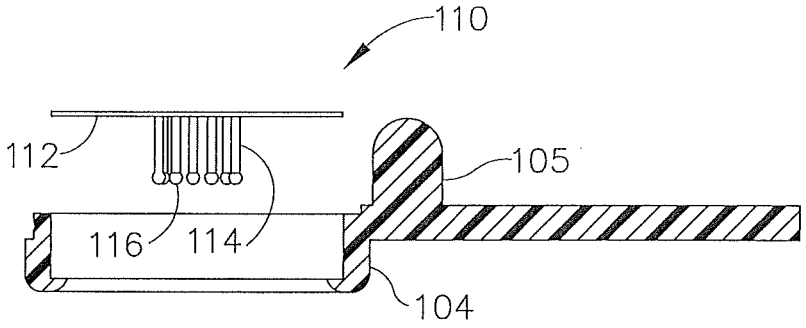
FIG. 3A depicts a cross-sectional side view of a flexible bristle member having a disc being inserted into the exemplary highlight applicator of FIG. 1.
Figure 3B:
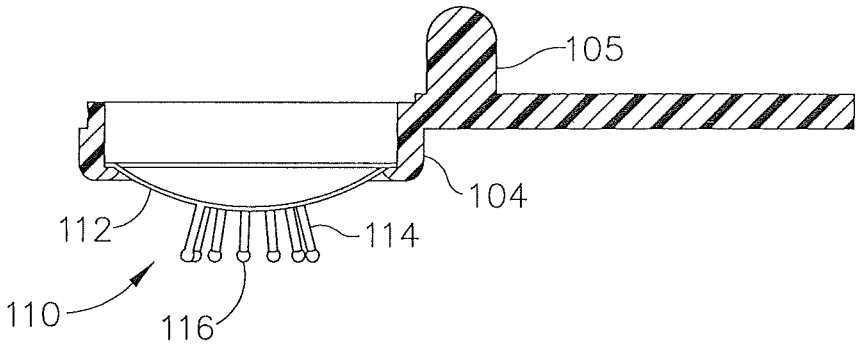
FIG. 3B depicts a cross-sectional side view of the flexible bristle member of FIG. 3A having been inserted into the exemplary highlight applicator of FIG. 1.
Figure 3C:
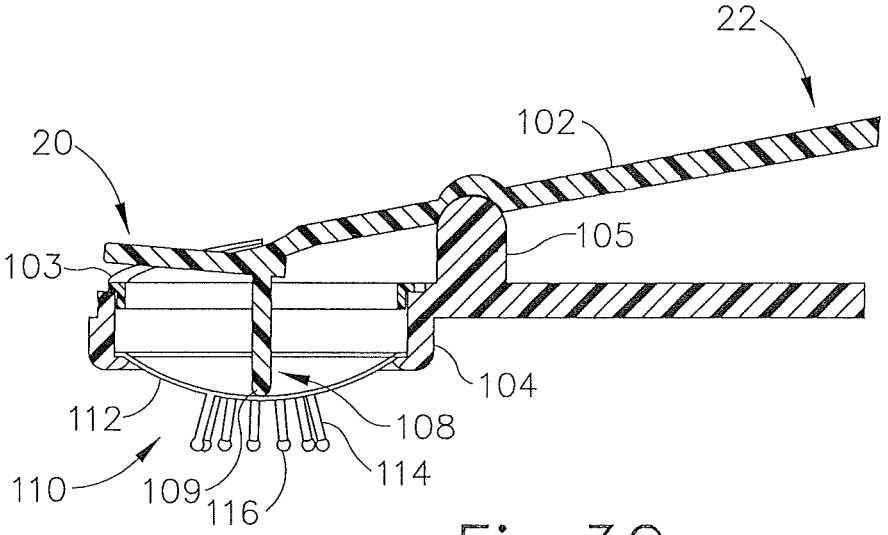
FIG. 3C depicts a cross-sectional side view of the flexible bristle member of FIG. 3A having been inserted into the exemplary highlight applicator of FIG. 1 and coupled with a lever.

Flexible bristle member (110) is disposed within body (104) and is configured to create a frictional seal between the exterior circumference of flexible bristle member (110) and an interior circumference of body (104). This frictional seal is caused by disc (112) of flexible bristle member (110) having a slightly larger overall diameter than an interior circumference of body (104) as shown in FIG. 3A. Such a configuration causes flexible bristle member (110) to deform from its original predetermined shape to one having an exterior convex shape when assembled, as shown in FIGS. 3B and 3C. Such a deformation causes flexible bristle member (110) to exert an outwardly biased force against the interior of body (104) in an effort to return to flexible bristle member's (110) original predetermined shape. This outwardly biased force creates the frictional seal between flexible bristle member (110) and body (104) and allows flexible bristle member (110) to remain in place during operation. It should be understood, that although in the present example, the frictional seal created between flexible bristle member (110) and body (104) allows flexible bristle member (110) to remain in place during operation, other methods of maintaining the position of flexible bristle member (110) may be utilized and would be apparent to one skilled in the art. For instance, as shown in FIGS. 31-32C and 34-35C, a rubber stopper (113) may be utilized between flexible bristle member (110) and adjuster (103) to maintain the positioning of flexible bristle member (110) during operation.

Lever (102) pivots about a pivot member (105) which is an integral portion of body (104). It should be understood that pivot member (105) may be positioned at any appropriate point along body (104). It should also be understood that pivot member (105) may be positioned such that proximal end (20) of lever (102) is in a position above body (104), or alternatively pivot member (105) may be positioned such that proximal end (20) of lever (102) is in a position within body (104). When not in use, lever (102) remains in an open position as shown in FIG. 2A due to the deformation of flexible bristle member (110) discussed above. When in use, a user may operate lever (102) by causing lever (102) to pivot about pivot member (105). Such operation causes distal end (22) of level (102) to lower and proximal end (20) of lever (102) to rise until lever (102) has reached a closed position as shown in FIG. 2C. Such a rise in proximal end (20) of lever (102) causes the center of flexible bristle member (110) to rise as well due to flexible bristle member (110) being coupled to proximal end (20) of lever (102) as discussed above. Rising of the center of flexible bristle member (110) brings disc (112) of flexible bristle member (110) closer to its original predetermined shape. As will be discussed below, this impacts the positioning of bristle tips (116) relative to each other. Because of the frictional seal between the exterior circumference of flexible bristle member (110) and the interior of body (104), the exterior circumference of flexible bristle member (110) remains in place during operation of lever (102).

Although exemplary highlight applicator (100) of the present example utilizes lever (102) to bring flexible bristle member (110) towards its original shape, other methods may be used and would be apparent to one skilled in the art. For instance, a biased spring, a biased spring and can system, a biased spring and rotary ratchet system (U.S. Pat. No. 3,288,115, entitled "Ball-Point Pen Mechanism", issued Nov. 29, 1966; U.S. Pat. No. 4,991,988, entitled "Component Writing Instrument Having Retractable Cartridge", issued Feb. 12, 1991; and U.S. Pat. No. 7,981,094, entitled "Two Position Septum For Implantable Vascular Access Device", issued Jul. 19, 2011) or negative fluid pressure among many other methods may be used to provide the force necessary to bring flexible bristle member (110) towards its original shape.

Figure 7A:
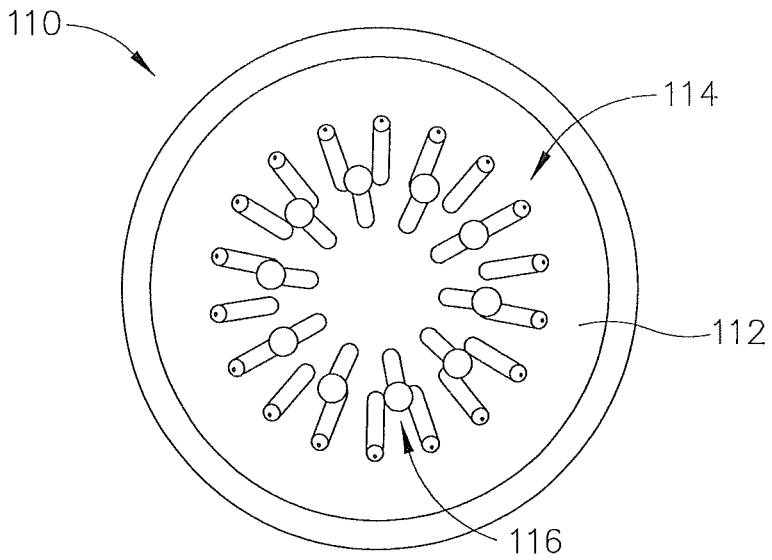
FIG. 7A depicts a bottom view of another bristle configuration of the exemplary highlight applicator of FIG. 1.
Figure 7B:
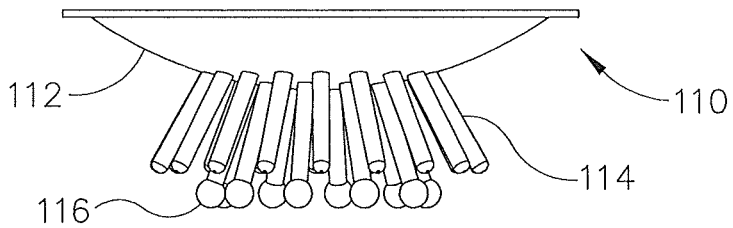
FIG. 7B depicts a side view of the bristle configuration of FIG. 7A in an open position.
Figure 7C:
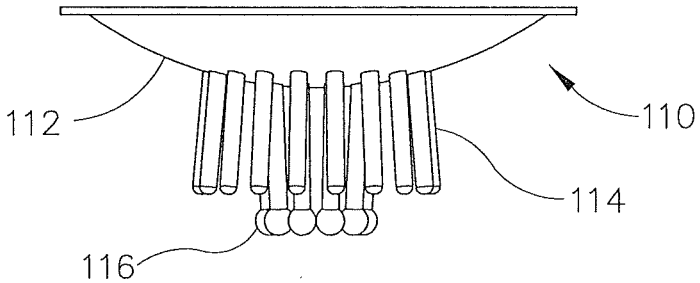
FIG. 7C depicts a side view of the bristle configuration of FIG. 7A in a closed position.
Figure 8A:
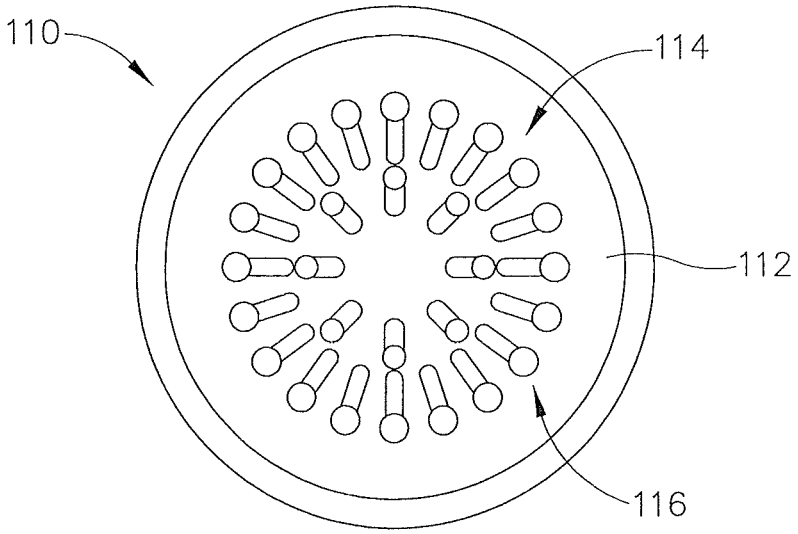
FIG. 8A depicts a bottom view of another bristle configuration of the exemplary highlight applicator of FIG. 1.
Figure 8B:
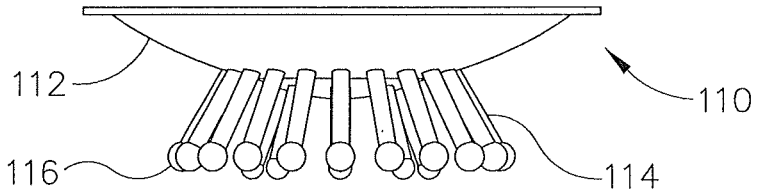
FIG. 8B depicts a side view of the bristle configuration of FIG. 8A in an open position.
Figure 8C:
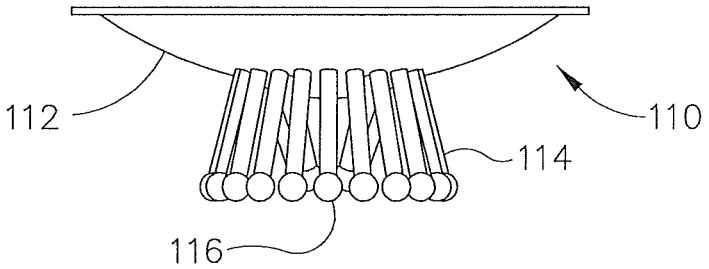
FIG. 8C depicts a side view of the bristle configuration of FIG. 8A in a closed position.
Figure 9:
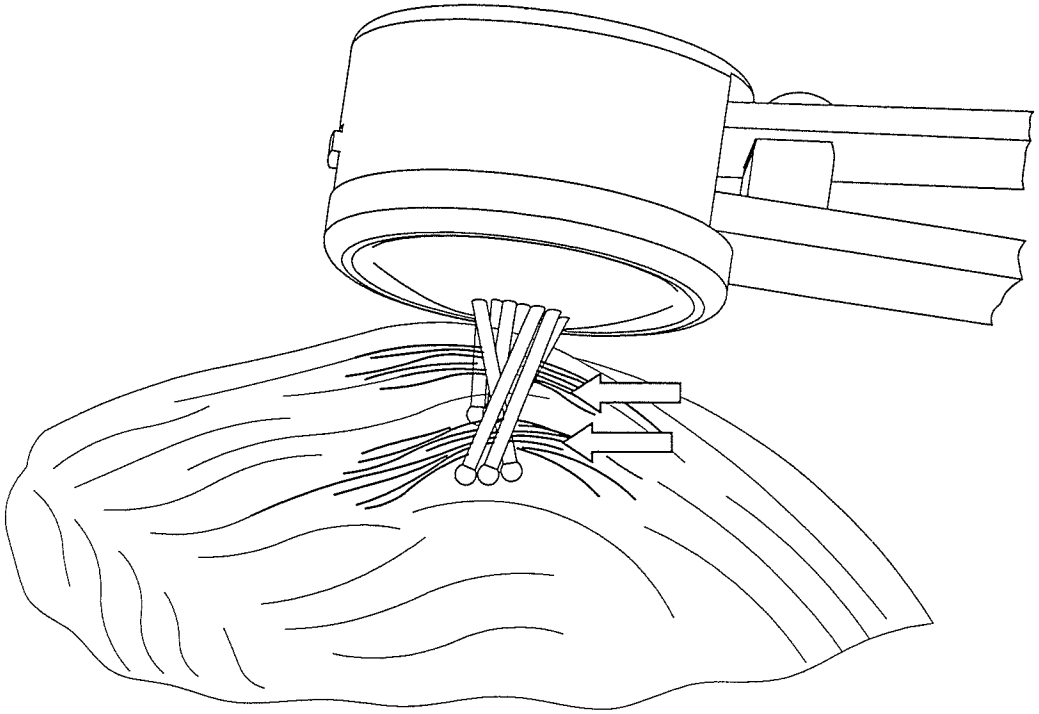
FIG. 9 depicts a view of the exemplary highlight applicator of FIG. 1, having the bristle configuration of FIG. 6A closed around two strands of hair.
Figure 10A:
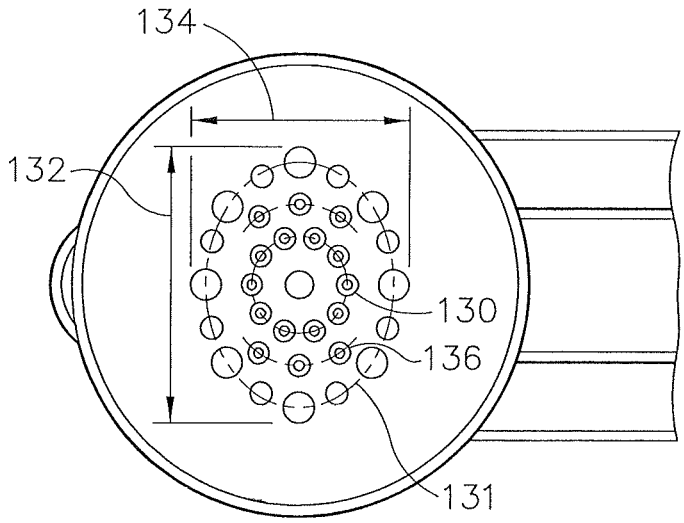
FIG. 10B depicts a side view of the bristle configuration of FIG. 10A in an open position.
FIG. 10C depicts a side view of the bristle configuration of FIG. 10A in a closed position.
Figure 10B:
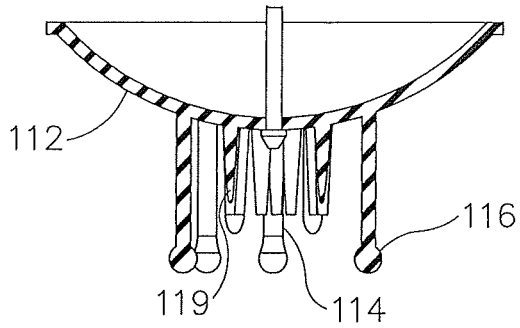
Figure 10C:
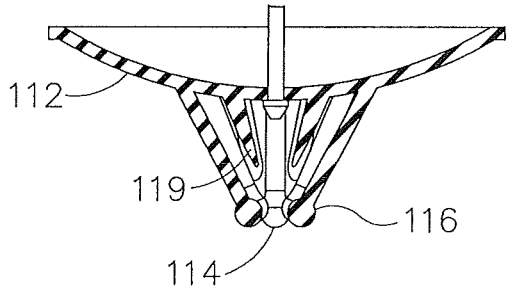

Each bristle of the plurality of bristles (114) has a spherical tip (116). While not required, spherical tips (116) can help prevent scalp damage during use, however many other tips would be suitable and would be apparent to one of ordinary skill in the art. For instance pointed tips (119) as shown in FIGS. 10A-10C may be utilized. Prior to assembly, bristles (114) are arranged to create a conical shape with spherical tips (116) of bristles (114) creating a peak of the conical shape. As discussed above, when assembled, flexible bristle member (110) becomes deformed. As a result of this deformation, positioning of the tips (116) of the bristles (114) deforms as well, and bristles (114) open up as shown in FIG. 2A. As discussed above, operation of level (102) brings disc (112) of flexible bristle member (110) closer to its original predetermined shape. This causes bristles (112) to return to their original conical shape as shown in FIG. 2C. The conical of bristles (114) creates a means by which strands of hair may be grasped. As shown in FIGS. 6A-8C and 10A-10C, bristles (114) of flexible bristle member (110) may be of different lengths and/or configured at different radial distances from the center of disc (112) in order to create multiple conical shapes. A multitude of conical shapes may allow for different and/or variable conical peak widths, more or less control over the even application of a hair coloring composition, and tighter or looser grasps of the strands of hair and/or the hair coloring composition. As shown in FIG. 9, multiple conical shapes also allow for the user to grasp multiple strands of hair at once.

Figure 4A:
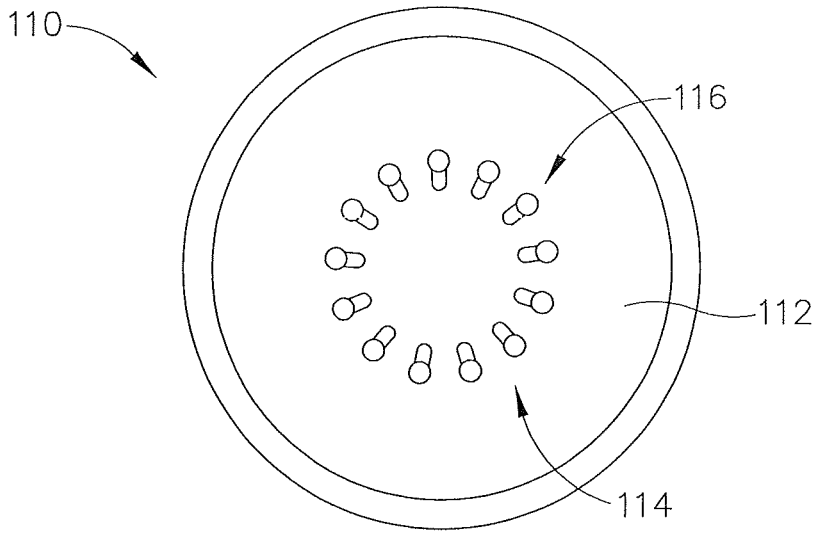
FIG. 4A depicts a bottom view of a bristle configuration of the exemplary highlight applicator of FIG. 1.
Figure 4B:
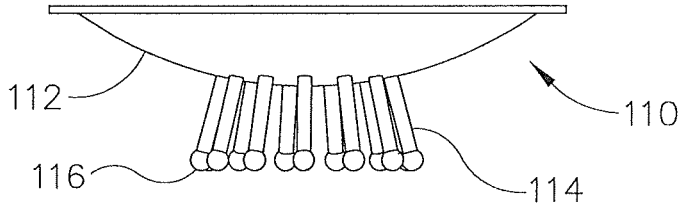
FIG. 4B depicts a side view of the bristle configuration of FIG. 4A in an open position.
Figure 4C:
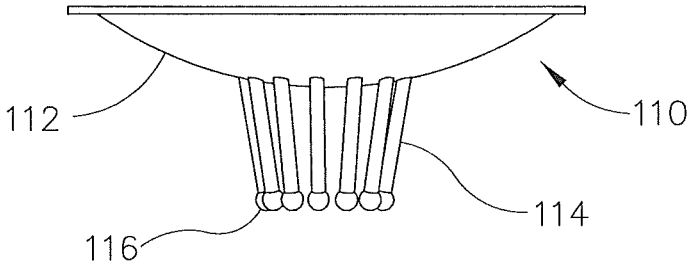
FIG. 4C depicts a side view of the bristle configuration of FIG. 4A in a closed position.
Figure 5A:
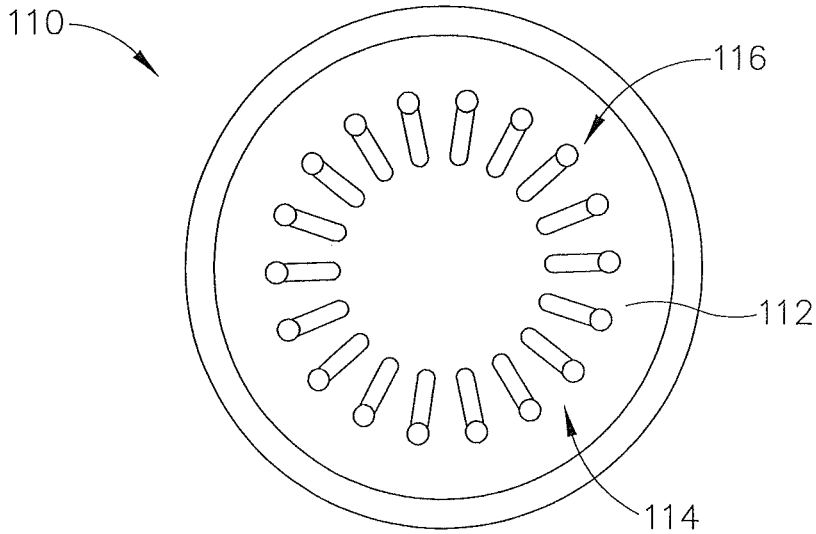
FIG. 5A depicts a bottom view of another bristle configuration of the exemplary highlight applicator of FIG. 1.
Figure 5B:
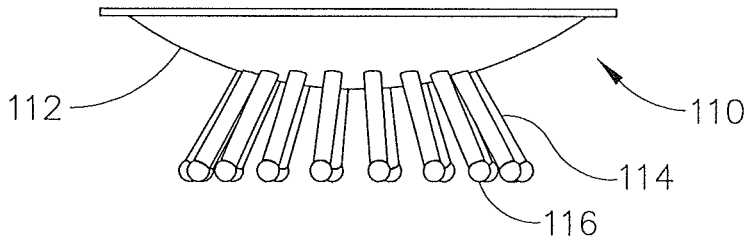
FIG. 5B depicts a side view of the bristle configuration of FIG. 5A in an open position.
Figure 5C:
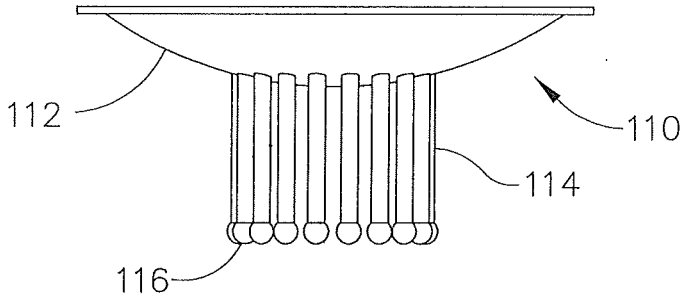
FIG. 5C depicts a side view of the bristle configuration of FIG. 5A in a closed position.
Figure 6A:
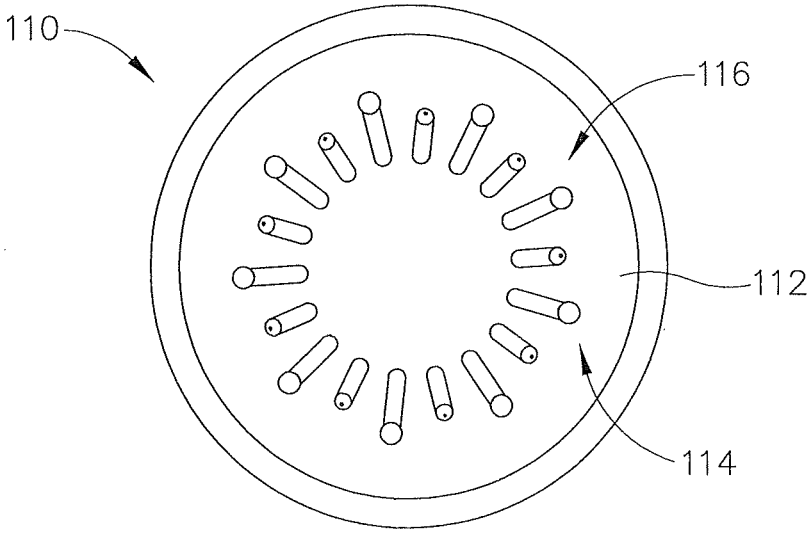
FIG. 6A depicts a bottom view of another bristle configuration of the exemplary highlight applicator of FIG. 1.
Figure 6B:
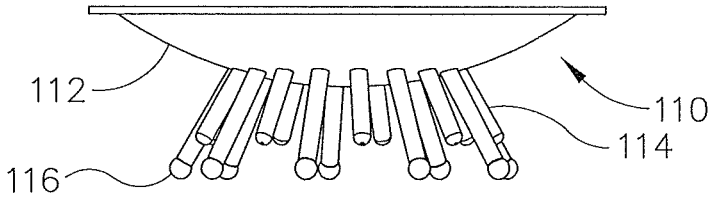
FIG. 6B depicts a side view of the bristle configuration of FIG. 6A in an open position.
Figure 6C:
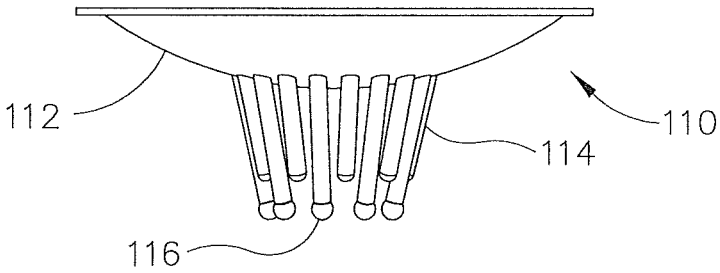
FIG. 6C depicts a side view of the bristle configuration of FIG. 6A in a closed position.
Figure 11A:
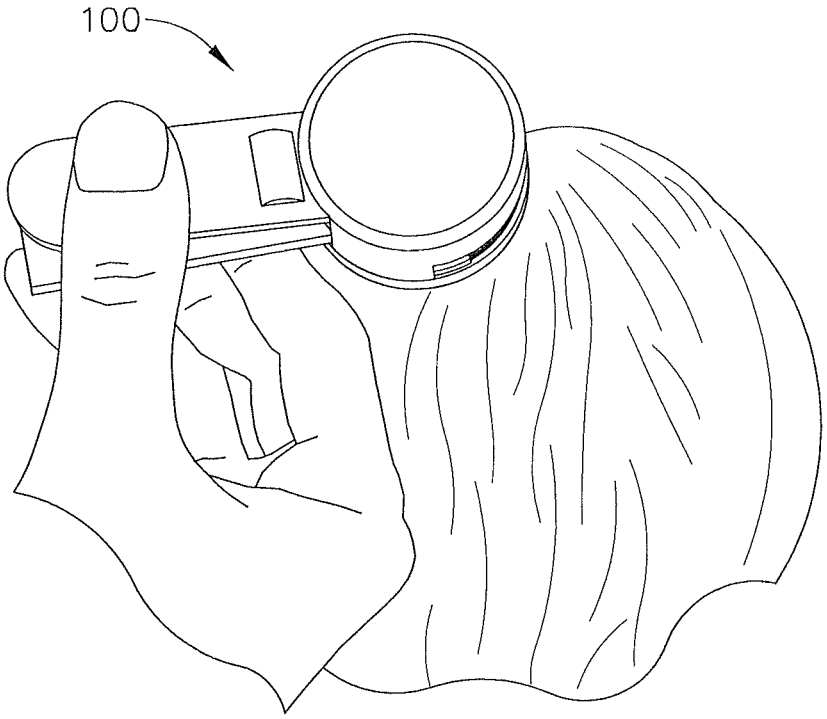
FIG. 11A depicts a perspective view of the highlight applicator of FIG. 1 oriented to grasp a section of hair along a minor axis of the elliptical pattern of the bristle configuration of FIG. 10A.
Figure 11B:
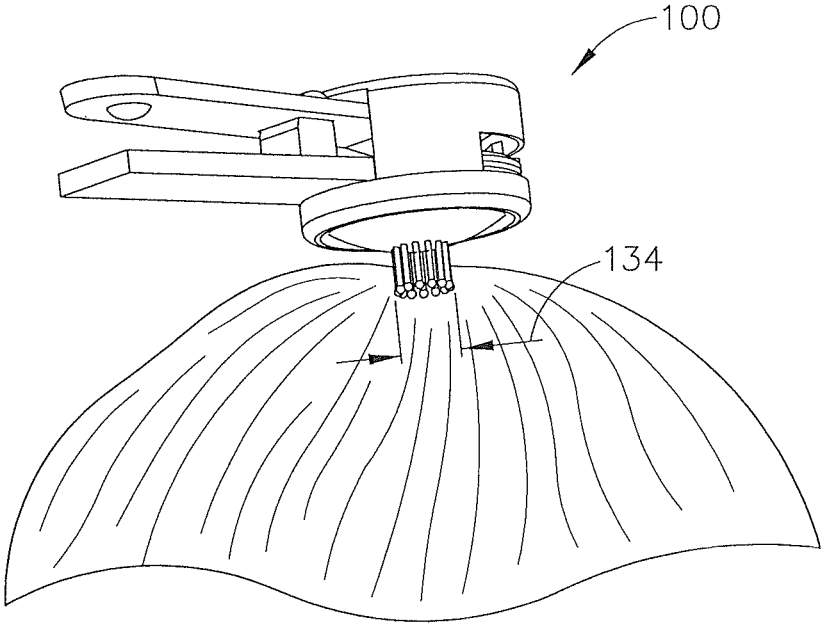
FIG. 11B depicts a perspective view of the highlight applicator of FIG. 1 having grasped a section of hair along the minor axis of the elliptical pattern of the bristle configuration of FIG. 10A.
Figure 11C:
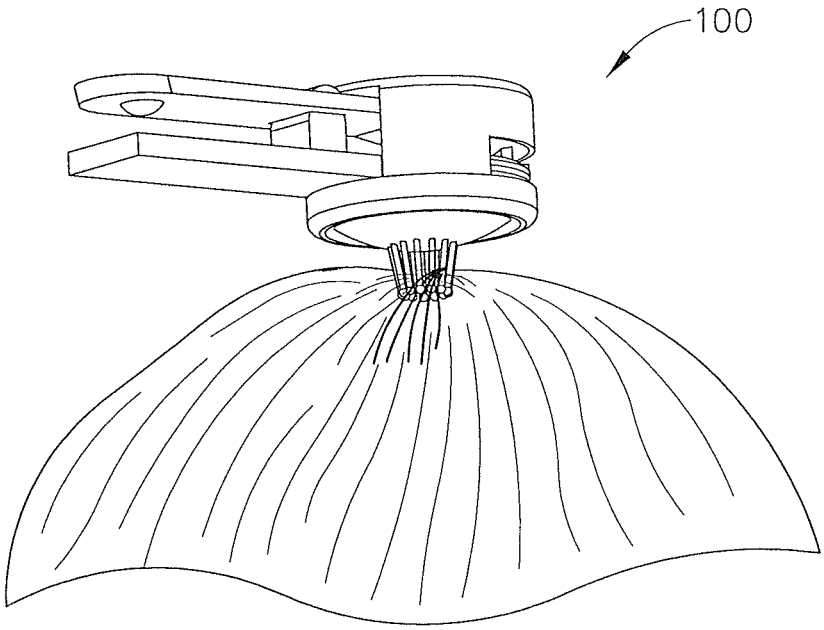
FIG. 11C depicts a perspective view of the highlight applicator of FIG. 1 having grasped a section of hair along the minor axis of the elliptical pattern of the bristle configuration of FIG. 10A.
Figure 12A:
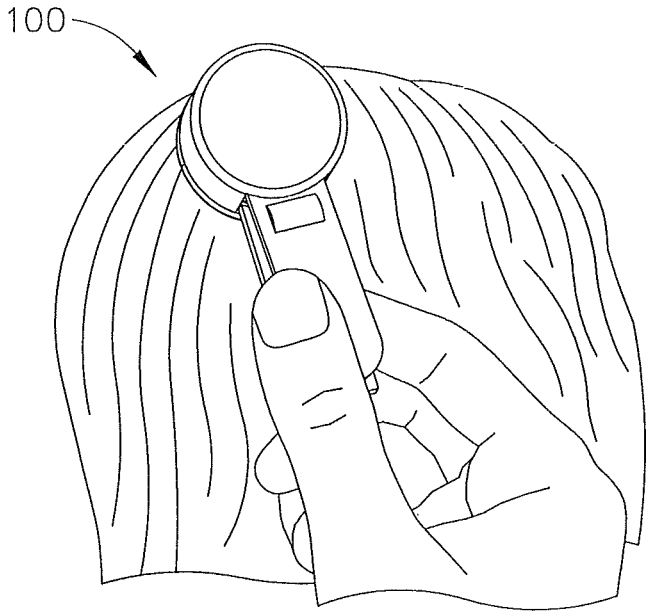
FIG. 12A depicts a perspective view of the highlight applicator of FIG. 1 oriented to grasp a section of hair along a major axis of the elliptical pattern of the bristle configuration of FIG. 10A.
Figure 12B:
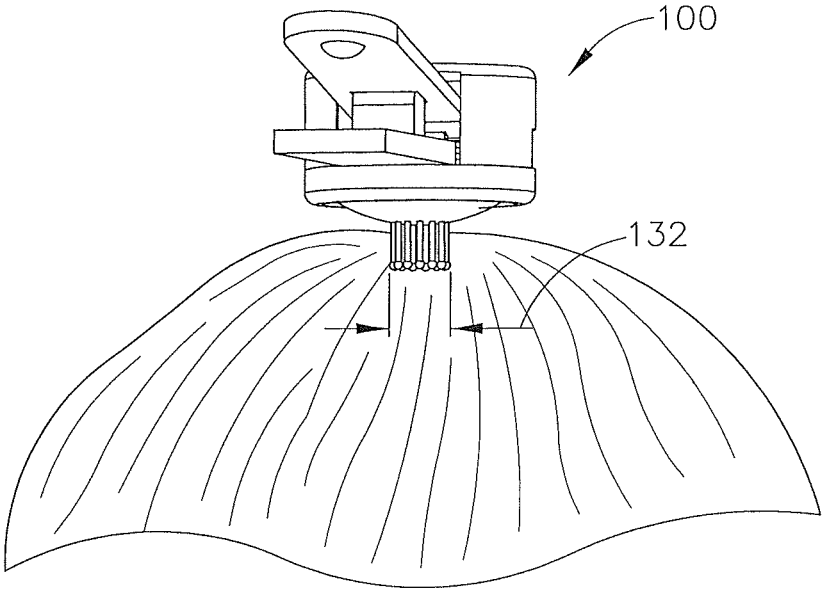
FIG. 12B depicts a side view of the highlight applicator of FIG. 1 oriented to grasp a section of hair along the major axis of the elliptical pattern of the bristle configuration of FIG. 10A.
Figure 12C:
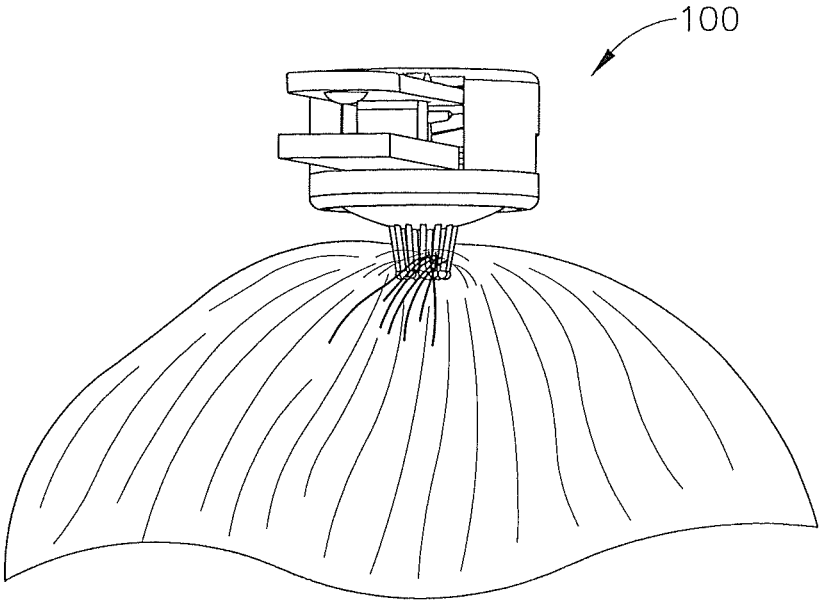
FIG. 12C depicts a perspective view of the highlight applicator of FIG. 1 having grasped a section of hair along the major axis of the elliptical pattern of the bristle configuration of FIG. 10A.
Figure 13:
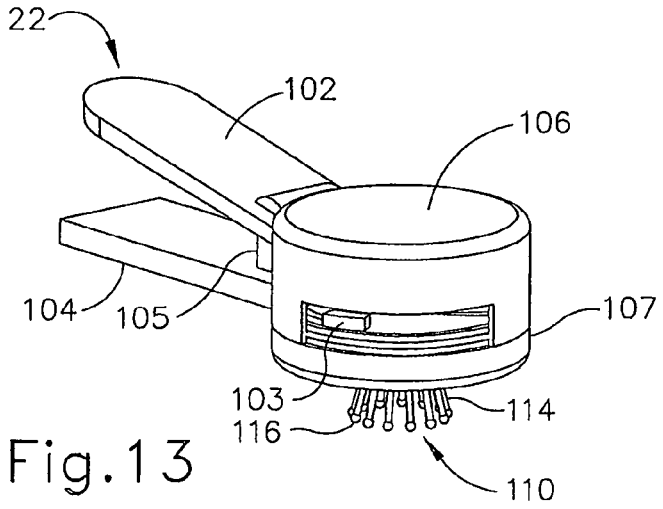
FIG. 13 depicts a perspective view of the exemplary highlight applicator of FIG. 1 having an adjuster.
Figure 14:
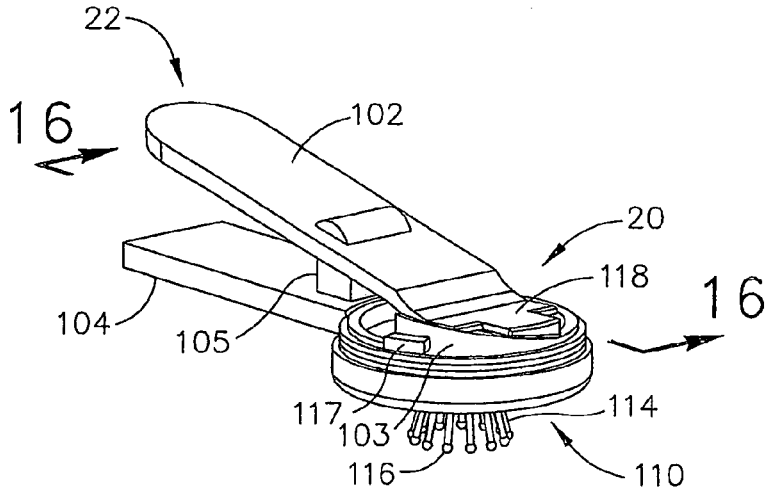
FIG. 14 depicts a perspective view of the exemplary highlight applicator of FIG. 1 with a cap removed and the adjuster in a wide position.
Figure 15:
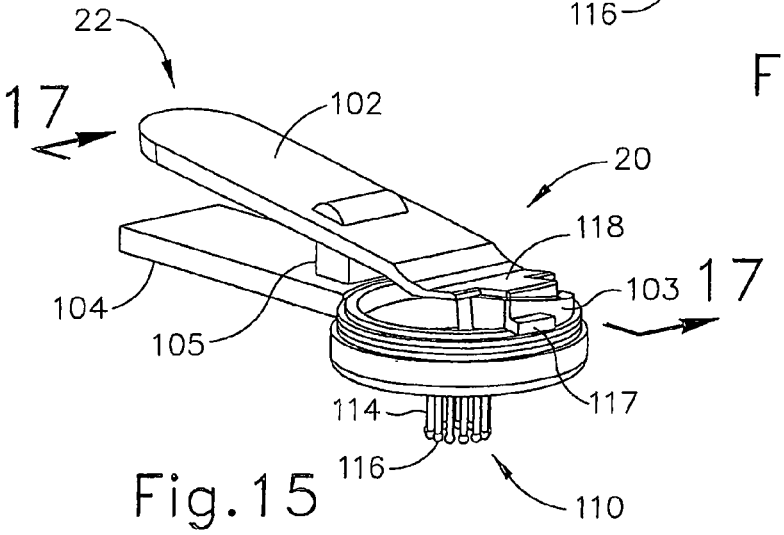
FIG. 15 depicts a perspective view of the exemplary highlight applicator of FIG. 1 with a cap removed and the adjuster in a narrow position.

Although the exemplary highlight applicator (100) of the present example utilizes bristles (114) of equal length arranged in a singular circular pattern as shown in FIGS. 4A-4C, other lengths and arrangements may be used and would be apparent to one skilled in the art. For instance, as shown in FIGS. 5A-5C, bristles (114) may be of equal length, may be arranged in a singular circular pattern, and may comprise a larger number of bristles (114) to provide for more control. As shown in FIGS. 6A-6C, bristles (114) may be of different lengths and may be arranged in a singular circular pattern. As shown in FIGS. 7A-7C, bristles (114) may be arranged in multiple circular patterns at different radial lengths from the center of flexible bristle member (110), wherein each circular pattern comprises bristles (114) of a different length. As shown in FIGS. 8A-8C, bristles (114) may be arranged in multiple circular patterns at different radial lengths from the center of flexible bristle member (110), wherein each circular pattern comprises bristles (114) of the same length. Finally as shown in FIGS. 10A-10C, bristles (114) may be arranged to form an inner circular ring (130) and an outer elliptical ring (131) having a major axis (132) and a minor axis (134) with a plurality of partial rings (136) between inner circular ring (130) and outer elliptical ring (131). As can be seen in FIGS. 11A-11C, if a user wishes to grab more hair, the user may orient highlight applicator (100) such that major axis (132) is transverse to the direction of the hair. As can be seen in FIG. 12A-12C, if a user wishes to grab less hair, the user may orient highlight applicator (100) such that the minor axis (134) is transverse to the direction of the hair. Although bristles (114) may be arranged in each of the orientations discussed above, other arrangements may be used and would be apparent to one skilled in the art. It should be understood, that any bristle (114) arrangement discussed above may be utilized in association with disc (112) and/or any of the alternative discs discussed below.

Figure 16:
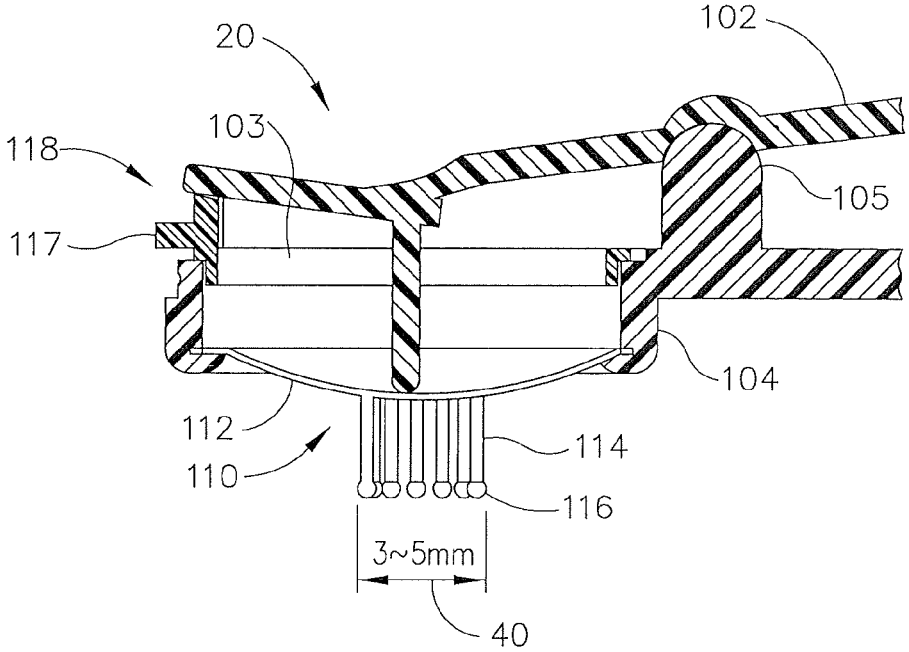
FIG. 16 depicts a cross-sectional side view of the exemplary highlight applicator of FIG. 1 with the adjuster in a narrow position.
Figure 17:
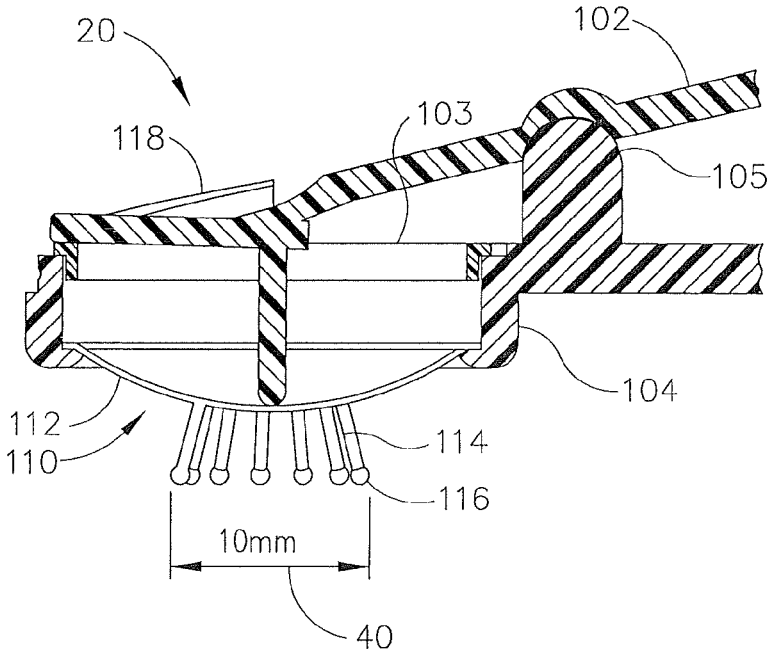
FIG. 17 depicts a cross-sectional side view of the exemplary highlight applicator of FIG. 1 with the adjuster in a wide position.

Adjuster (103) may be used to adjust the initial position of flexible bristle member (110). Adjuster (103) is disposed within the interior circumference of body (104) and rotates about a longitudinal axis of body (104). Adjuster (103) comprises a stop extrusion (117) which disposed within a window (107) formed between body (104) and cap (106) when the exemplary highlight applicator (100) is assembled. Stop extrusion (117) allows adjuster (103) to only rotate within predetermined angular limits. Adjuster (103) also comprises a radial ramp (118). Proximal end (20) of level (102) rests on radial ramp (118) of adjuster (103), and as adjuster (103) is rotated within window (107), proximal end (20) is raised or lowered according to the height of radial ramp (118). As previously discussed, raising proximal end (20) of lever (102) causes the center of flexible bristle member (110) to rise as well due to flexible bristle member (110) being coupled to proximal end (20) of lever (102). As also discussed above, as flexible bristle member (110) rises, flexible bristle member (110) begins to return to its original predetermined shape which causes bristles (114) to return to their original conical shape. As shown in FIGS. 16 and 17, the ability to adjust the initial position of flexible bristle member (110) allows the user to determine the initial peak conical width (40) of the bristles (114). In exemplary highlight applicator (100) the range of initial peak conical width (40) ranges from about 3 mm to about 10 mm, however, other ranges may be achieved with different bristle lengths and/or configurations. Such a range allows the user to grasp more or less hair when applying the hair coloring composition. Although the exemplary highlight applicator (100) of the present example utilizes a radial ramp (103) to adjust the initial peak conical width (40), the other methods of adjusting the initial peak conical width (40) other methods may be used and would be apparent to one skilled in the art. For instance, a threaded or notched member among many other methods may be used to provide the necessary means with which to adjust the initial peak conical width (40).

Once the user has adjusted the initial peak conical width (40) using the adjuster (103), the user may apply a hair coloring composition, for example a suspension, an emulsion, a viscous solution, a gel, a lotion, a foam, or a cream hair coloring or dyeing product, to the space created between the bristles (114) of flexible bristle member (110). After applying an appropriate amount of hair coloring composition, the user then grasps a strand of hair within bristles (114) of flexible bristle member (110) by operating lever (102) as discussed above. While continuing to grasp the hair, the user combs the hair coloring composition encompassed in bristles (114) throughout the length of the strand of hair. This method of grasping and combing may be continued as many times as necessary to achieve the look desired.

Figure 18:
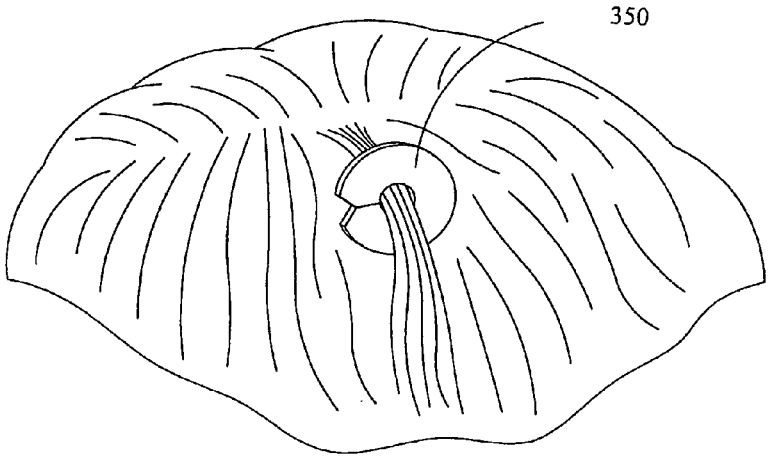
FIG. 18 depicts a perspective view of an exemplary clip clasped about a section of hair.

If the user so desires, the user may perform the additional steps of sectioning and clipping the hair. For instance, once the user has adjusted the initial peak conical width (40) using the adjuster (103), the user may grasp a strand or strands of hair within bristles (114) of flexible bristle member (110) by operating level (102) as discussed above. While continuing to grasp the hair, the user may section the hair by putting a clip (350) about the hair as shown in FIG. 18. These steps of grasping and sectioning may be repeated as many times as the user wishes, and may encompass as little or as much of the user's hair as desired. Once the user is satisfied with the amount and location of hair which has been sectioned, the user may then apply a hair coloring composition, for example a suspension, an emulsion, a viscous solution, a gel, a lotion, a foam, or a cream hair coloring or dyeing product, to the space created between the bristles (114) of flexible bristle member (11). After applying an appropriate amount of hair coloring composition, the user then grasps a section of hair within bristles (114) of flexible bristle member (110) by operating lever (102) as discussed above. While continuing to grasp the section of hair, the user combs the hair coloring composition encompassed in bristles (114) throughout the length of the section of hair. This method of grasping and combing may be continued as many times as necessary to achieve the look desired.

Figure 31:
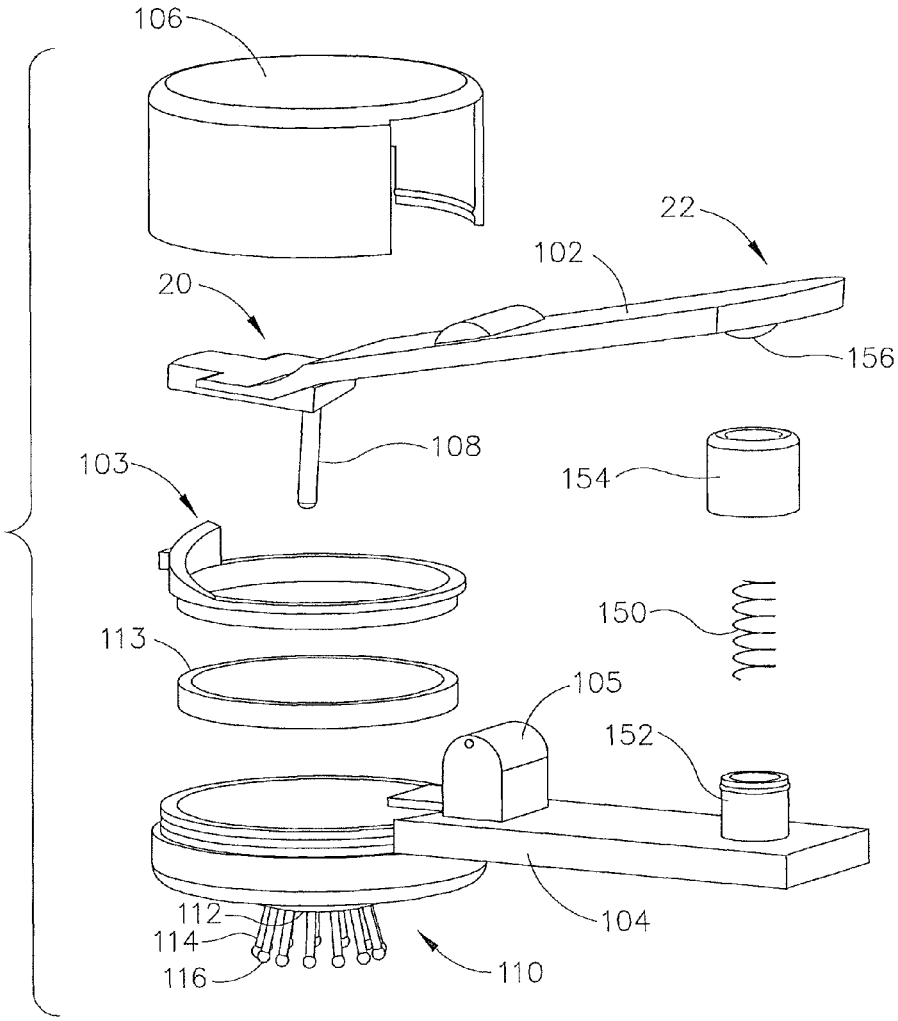
FIG. 31 depicts an exploded perspective view of an exemplary alternative highlight applicator having a spring mechanism.
Figure 33:
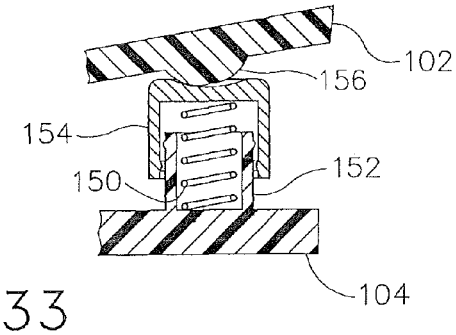
FIG. 33 depicts a detailed cross-sectional side view of the spring mechanism of the highlight applicator of FIG. 31.
Figure 32A:
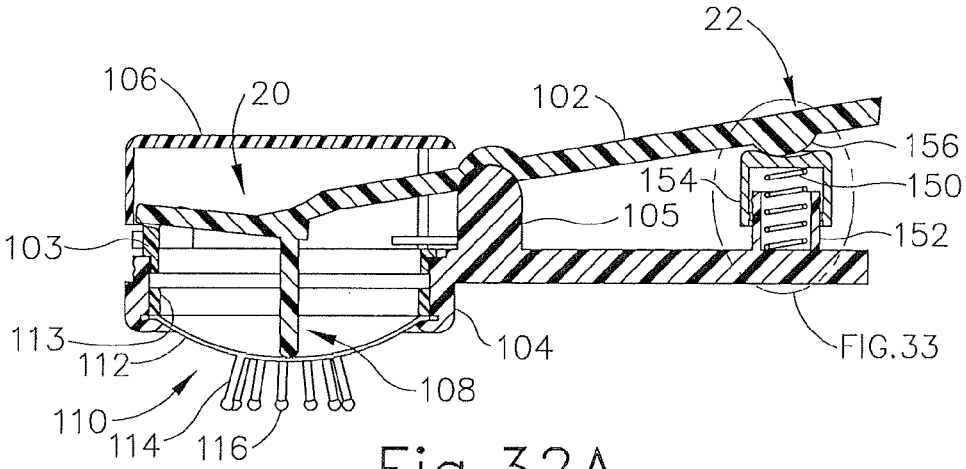
FIG. 32A depicts a cross-sectional side view of the highlight applicator of FIG. 31, in an open position.
Figure 32B:
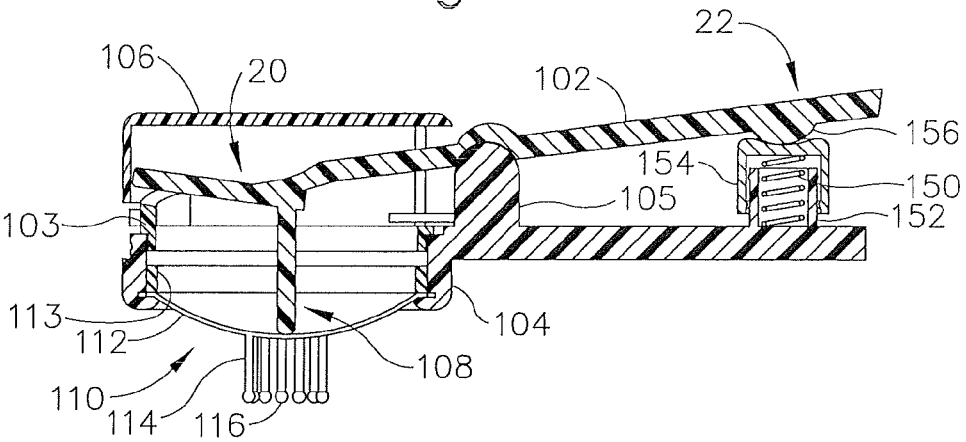
FIG. 32B depicts a cross-sectional side view of the highlight applicator of FIG. 31, in a transitional position.
Figure 32C:
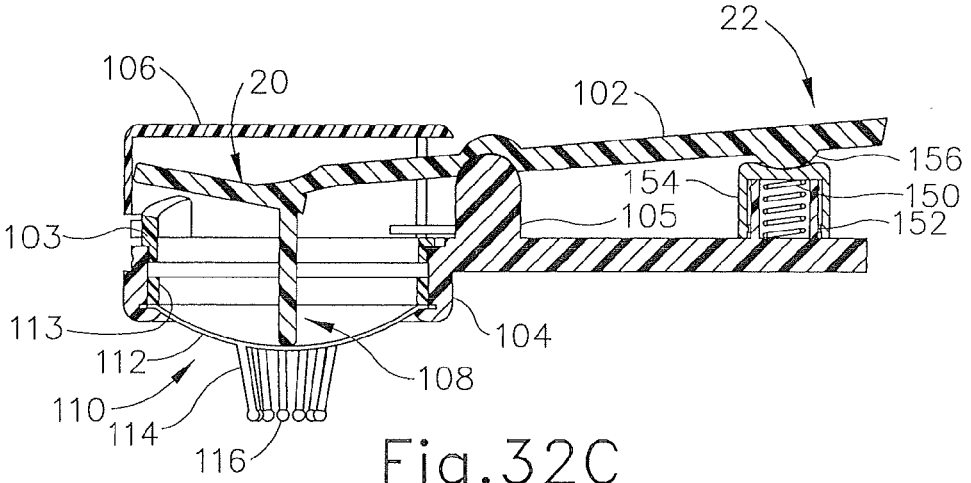
FIG. 32C depicts a cross-sectional side view of the highlight applicator of FIG. 31, in a closed position.

It should be understood, that highlight applicator (100) may further comprise a spring (150) as shown in FIG. 31. As best seen in FIGS. 32A-32C, in this example, spring (150) may be positioned to exert a bias upon distal end (22) of lever (102). This bias, in addition to or in lieu of the bias exerted upon proximal end (20) of lever (102) by the deformation of flexible bristle member (110) as discussed above, will cause lever (102) to remain in the open position as shown in FIG. 32A. Spring (150) is disposed within a canister (152). The bias exerted upon lever (102) is transferred through a cap (154) as shown in FIG. 33. As will be discussed below, spring (150) may be utilized to provide a force in order to deform a flat disc (332).

II. Exemplary Alternative Operation

Figure 34:
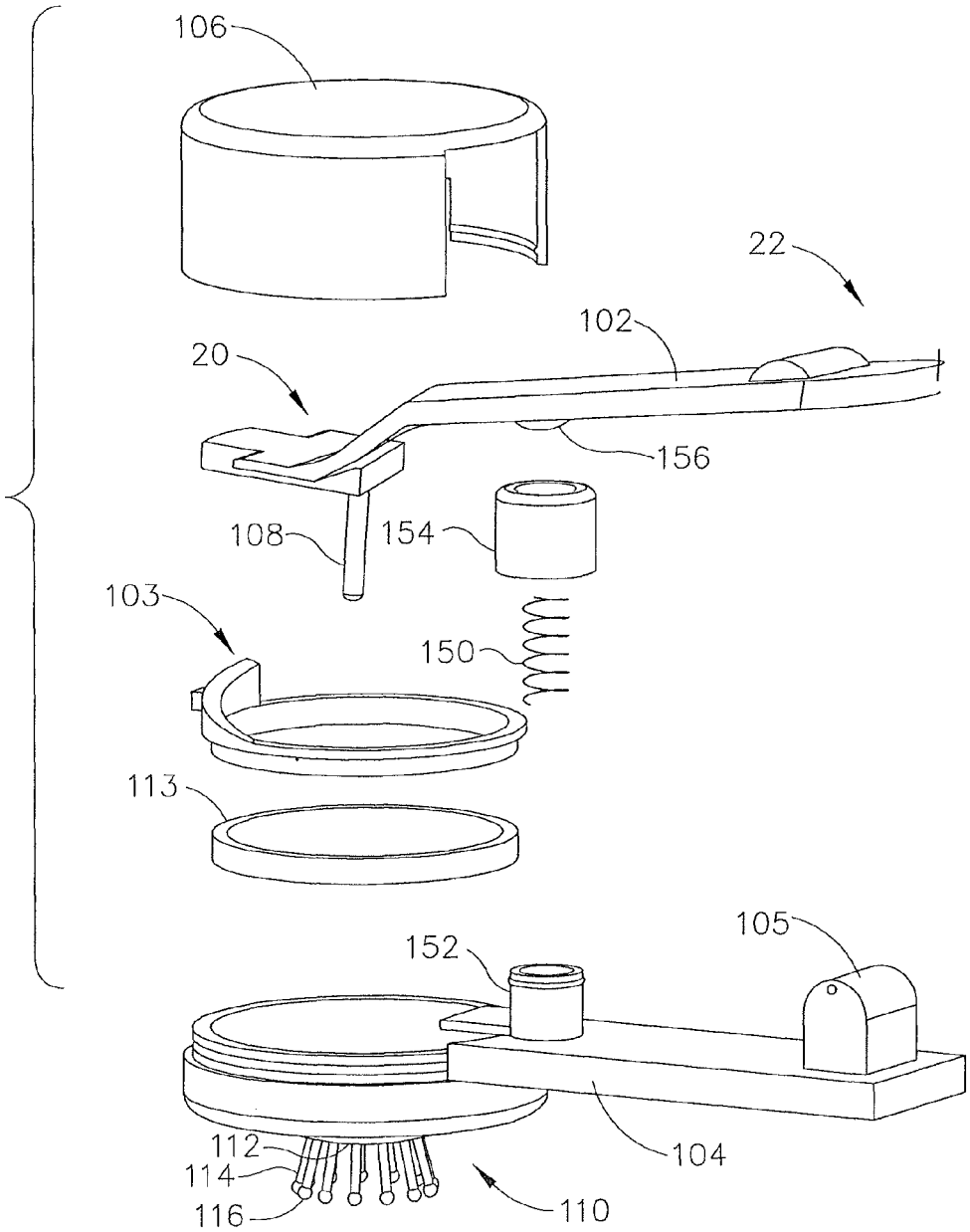
FIG. 34 depicts an exploded perspective view of another exemplary alternative highlight applicator having a spring mechanism.
Figure 35A:
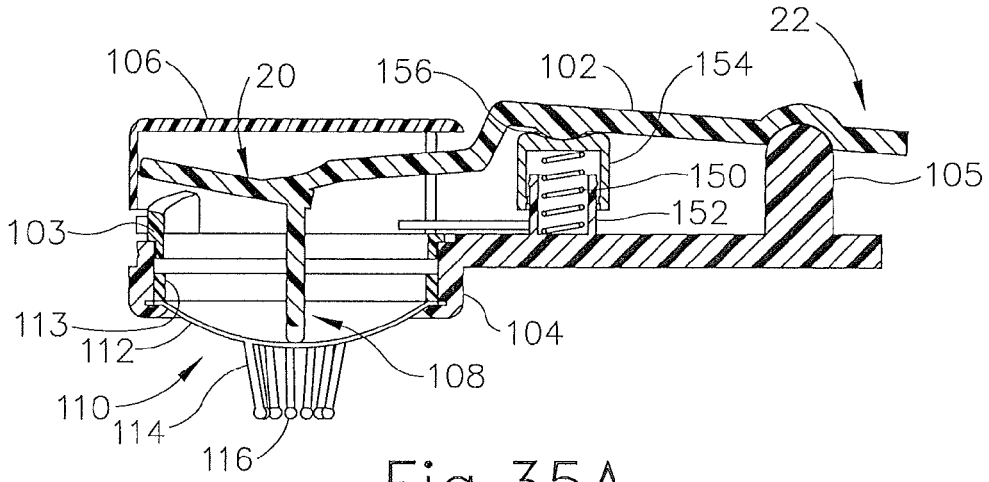
FIG. 35A depicts a cross-sectional side view of the highlight applicator of FIG. 34, in a closed position.
Figure 35B:
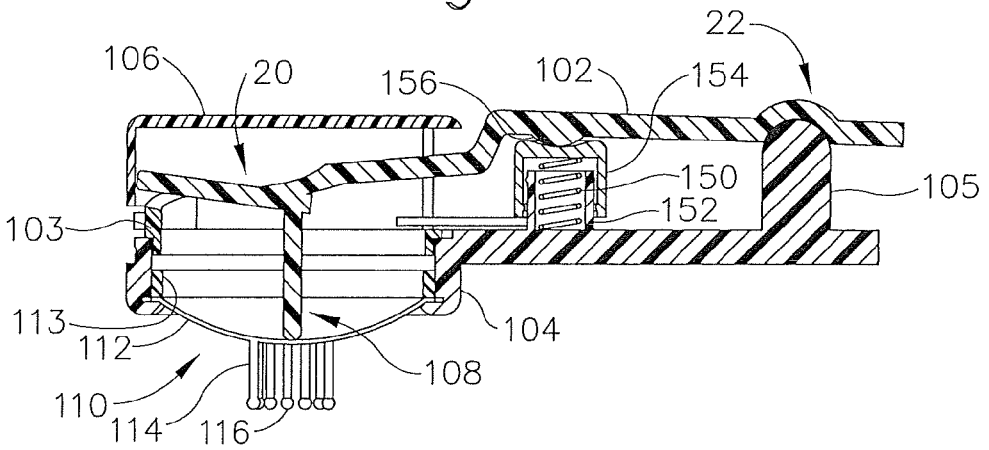
FIG. 35B depicts a cross-sectional side view of the highlight applicator of FIG. 34, in a transitional position.
Figure 35C:
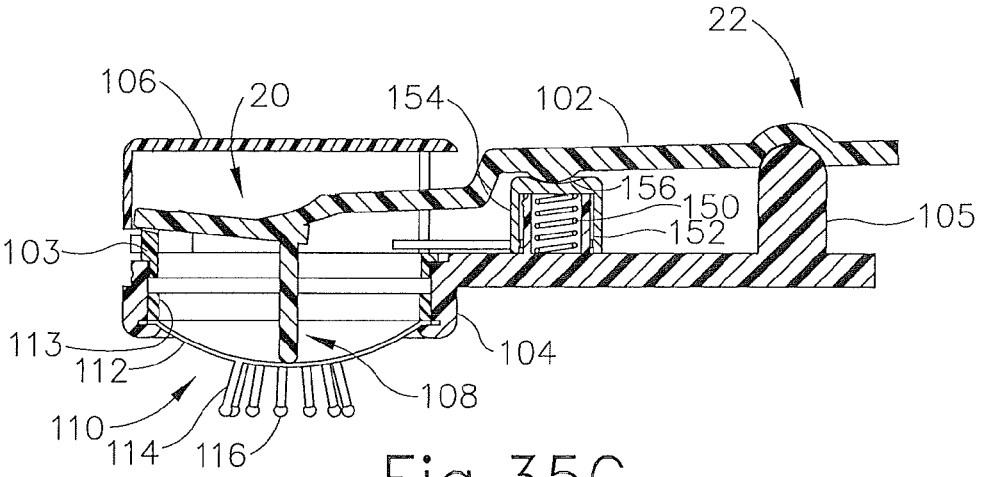
FIG. 35C depicts a cross-sectional side view of the highlight applicator of FIG. 34, in an open position.

Although when not in use, lever (102) of exemplary highlight applicator (100) of the present example remains in the open position as discussed above and as shown in FIG. 2A, lever (102) of highlight applicator (100) may be configured to remain in the closed position when not in use as discussed above and as shown in FIG. 2C. For instance, as shown in FIG. 34, highlight applicator (100) may further comprise spring (150). As best seen in FIGS. 35A-35C, however, spring (150) of this example may be positioned to exert a bias upon proximal end (20) of lever (102) to overcome the bias exerted upon proximal end (20) of lever (102) by the deformation of flexible bristle member (110) as discussed above. The bias exerted by spring (150) causes lever (102) to remain in the closed position as shown in FIG. 35A. In this closed position, bristles (114) remain in a closed position as well. Spring (150) is disposed within a canister (152). The bias exerted upon lever (102) is transferred through a cap (154).

When in use, a user may operate lever (102) by overcoming the bias exerted upon lever (102) by spring (150) and causing lever (102) to pivot about pivot member (105). Such operation causes distal end (22) of lever (102) to rise and proximal end (20) of lever (102) to lower until lever (102) has reached the open position as shown in FIG. 35C. Such lowering of proximal end (20) of lever (102) causes the center of flexible bristle member (110) to lower as well due to flexible bristle member (110) being coupled to proximal end (20) of lever (102) as discussed above. Lowering of the center of flexible bristle member (110) deforms disc (112) of flexible bristle member (110) further from its original predetermined shape. As discussed above, this impacts the positioning of bristle tips (116) relative to each other, and causes bristles to open as shown in FIG. 35C. In this open position, the user may apply a hair coloring composition, for example a suspension, an emulsion, a viscous solution, a gel, a lotion, a foam, or a cream hair coloring or dyeing product, to the space created between the bristles (114) of flexible bristle member (110). After applying an appropriate amount of hair coloring composition, the user then grasps a strand or strands of hair within bristles (114) of flexible bristle member (11) by releasing lever (102) and allowing lever (102) to return to the closed position as shown in FIG. 35A. While continuing to grasp the hair, the user combs the hair coloring composition encompassed in bristles (114) throughout the length of the strand of hair. This method of grasping and combing may be continued as many times as necessary to achieve the look desired. It should be understood that, although spring (150) is used to create the bias necessary to cause lever (102) to remain in a closed position when not in use, any other appropriate device or method may be used, and would be apparent to those skilled in the art.

III. Exemplary Alternative Highlight Applicator

Figure 19:
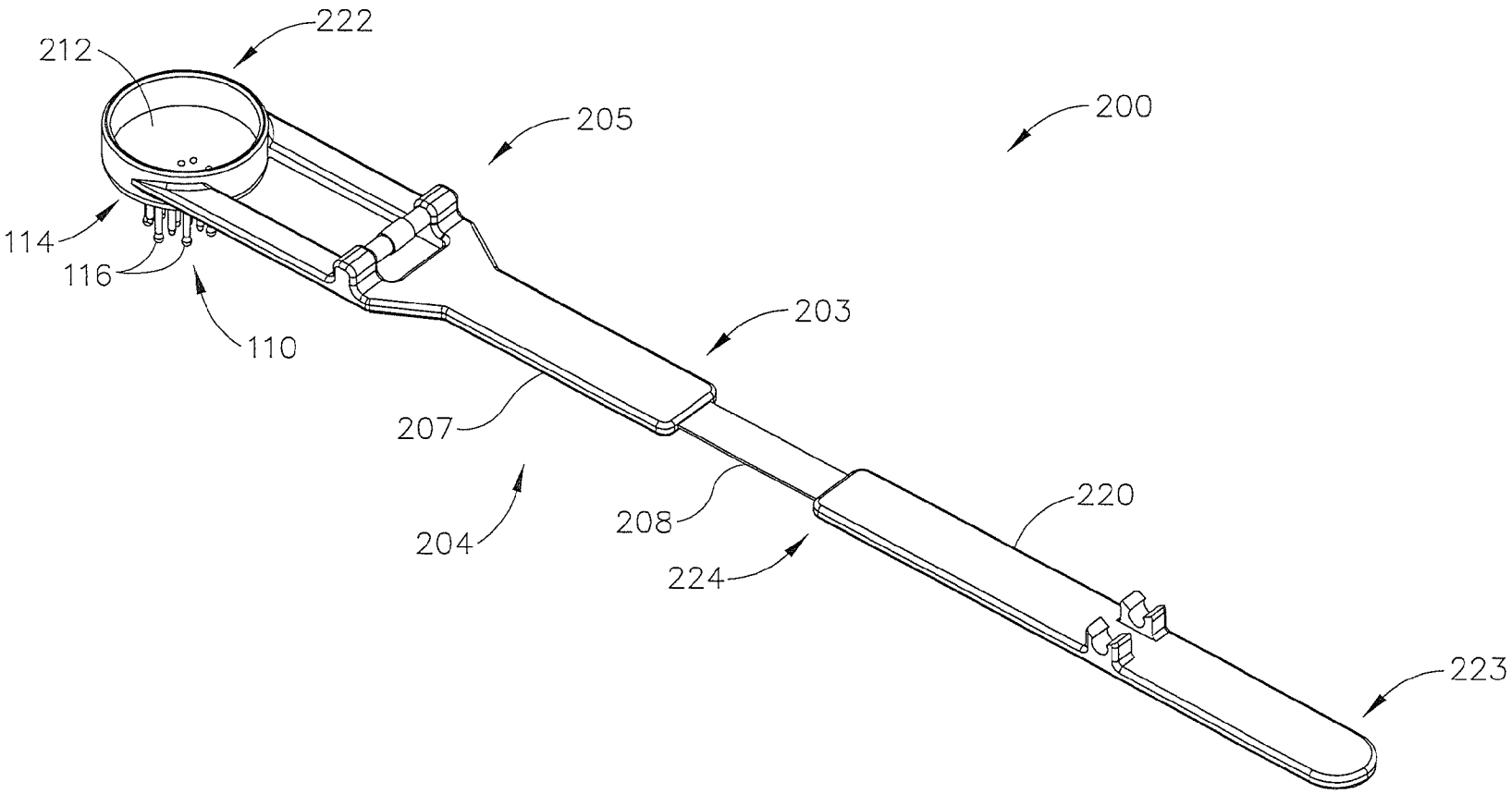
FIG. 19 depicts a perspective view of an exemplary alternative highlight applicator prior to assembly.
Figure 20:
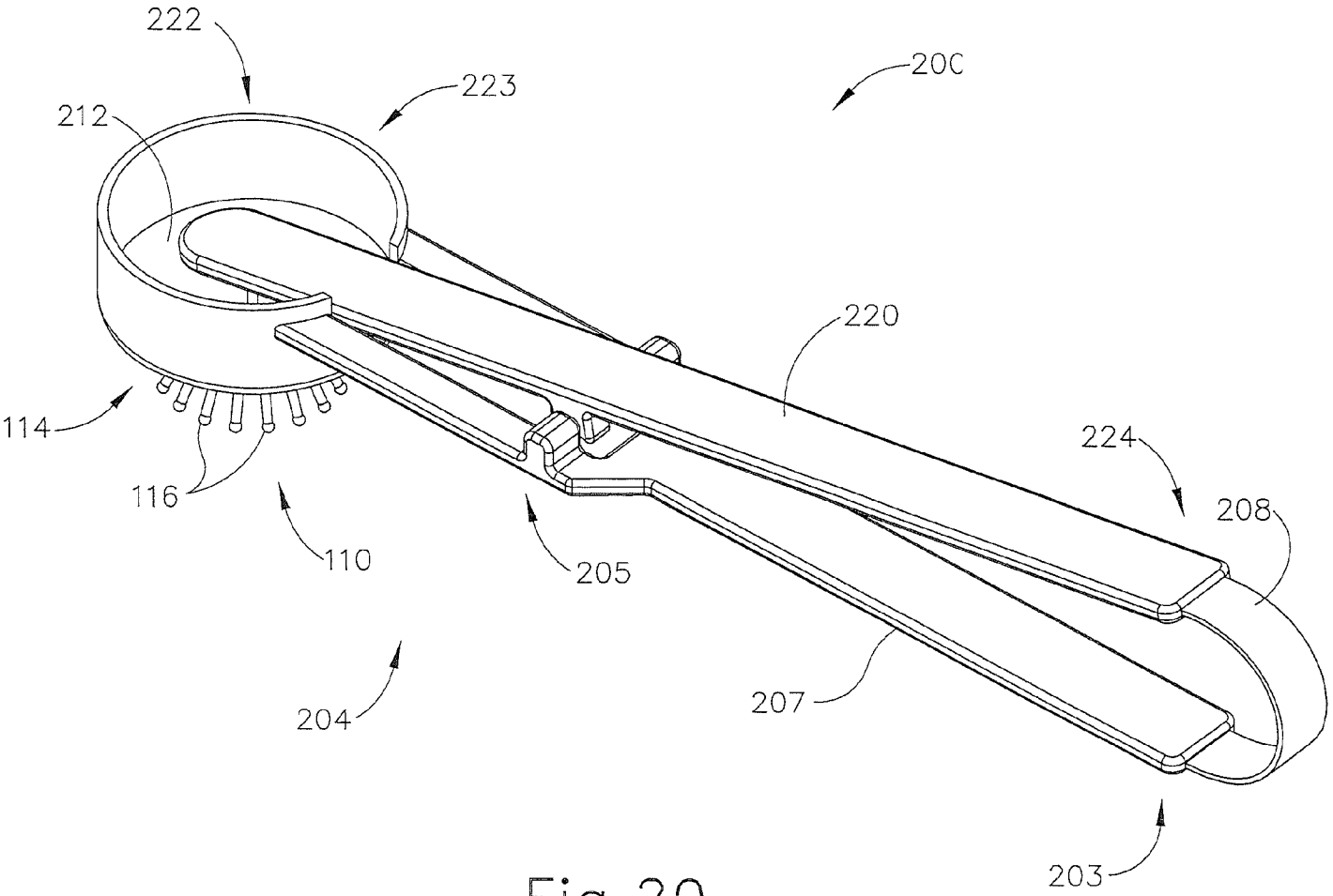
FIG. 20 depicts a perspective view of the highlight applicator of FIG. 19 after assembly.

FIGS. 19 and 20 depict an exemplary alternative highlight applicator (200). Like highlight applicator (100) described above, highlight applicator (200) of this example comprises a body (204), a lever (220), and a flexible bristle member (110). It should be understood that body (204), lever (220), and flexible bristle member (110) are configured to operate and function substantially similar to body (104), lever (102), and flexible bristle member (110) as discussed above. For instance, and among other similarities, flexible bristle member (110) is configured to deform and create a frictional seal between the exterior circumference of an interior circumference of body (204) upon assembly; and operation of level (220) may raise or lower the center of flexible bristle member (110) and manipulate the positioning of bristle tips (116) relative to each other.

Unlike highlight applicator (100) however, highlight applicator (200) further comprises a hinge member (208), among other differences. Hinge member (208) may be comprised of a thermoplastic elastomer (TPE, a.k.a. 'thermoplastic rubber'); however, any other suitable material may be used. Hinge member (208) is integrally coupled with body (204) at a distal end (203) of body and lever (220) at a distal end (224) of lever (220) such that body (204), lever (220), and hinge member (208) are one piece. Such integral coupling may be accomplished through a process of 2K or 'two shot' injection molding. A further benefit of utilizing a 2K or 'two shot' injection molding process is that body (204), lever (220), and hinge member (208) of highlight applicator (200) may be formed as one integral piece although being comprised individually of different materials. It should be appreciated however, that any other method or process of integrally coupling hinge member (208) with body (204) and lever (220) may be utilized.

Figure 21:
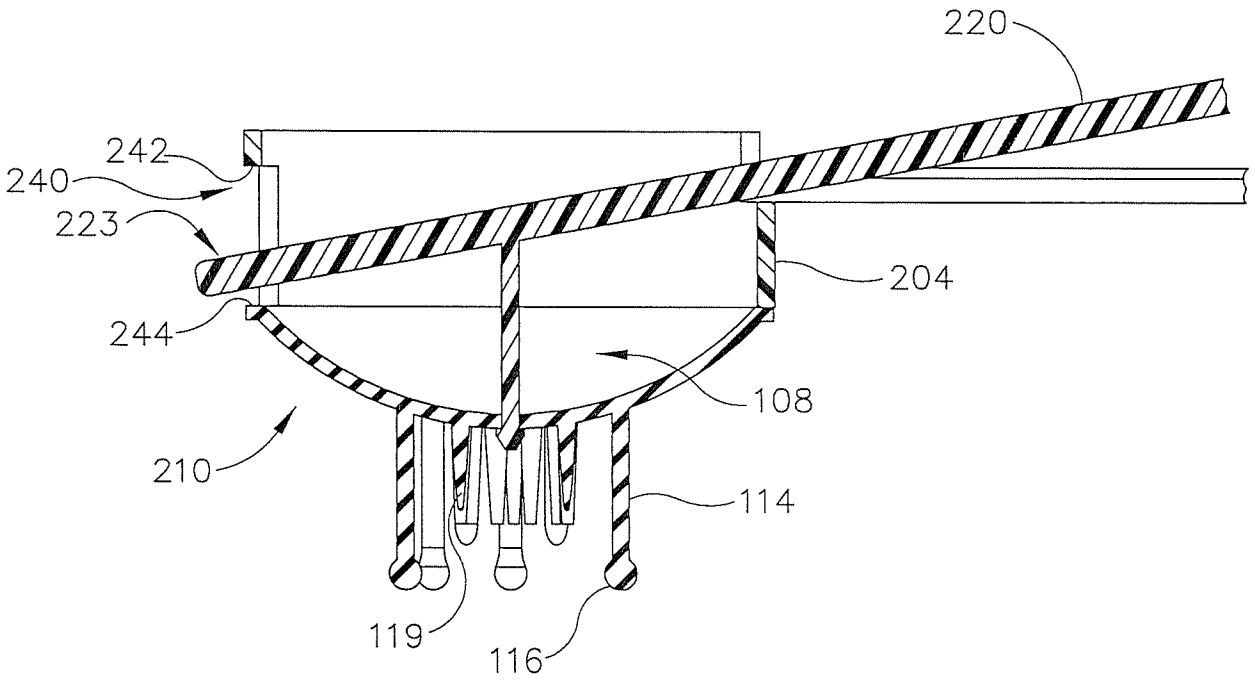
FIG. 21 depicts a cross-sectional side view of an exemplary alternative flexible bristle member and an exemplary alternative body of the highlight applicator of FIG. 19.
Figure 22:
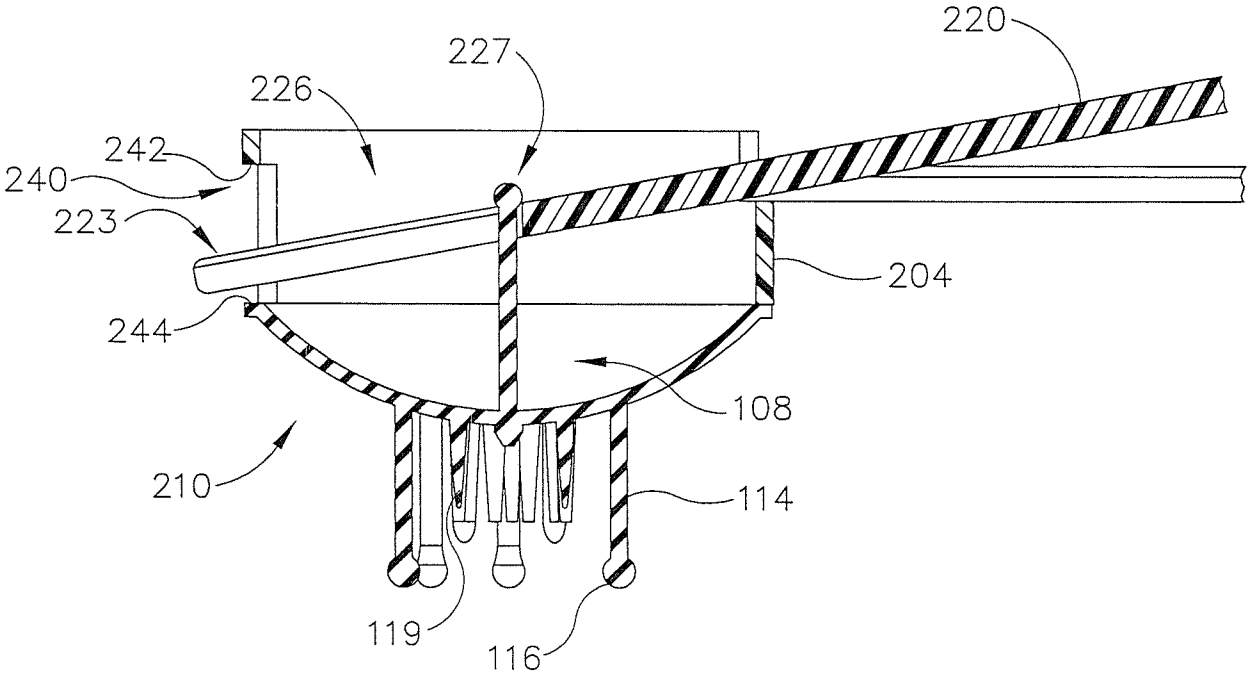
FIG. 22 depicts a cross-sectional side view of another exemplary alternative flexible bristle member and the alternative body of FIG. 21.

It should be understood that any component of highlight applicator (200) may be integrally coupled with any other suitable component or components of highlight applicator (200) through a process such as 2K or 'two shot' injection molding. For example, in some versions of highlight applicator (200), a flexible bristle member (210) may be integrally couples with body (204) such that flexible bristle member (210) and body (204) are one piece as shown in FIG. 21. It should be understood that flexible bristle member (210) is substantially identical to flexible bristle member (110) except that flexible bristle member (210) is integrally coupled with at least body (204). In other versions, flexible connector (108) may be integrally coupled with a proximal end (223) of lever (220) as shown in FIG. 21, or with flexible bristle member (110,210) as shown in FIG. 22. It should be understood, that flexible connector (108) may be integrally coupled with flexible bristle member (110) such that flexible connector (108) and flexible bristle member (110) alone are one piece; or flexible connector (108) may be integrally coupled with flexible bristle member (210) such that flexible connector (108), flexible bristle member (210), and any other component to which either flexible connector (108) and/or flexible bristle member (210) are coupled are one piece. Still in other versions, flexible connector (108), flexible bristle member (210), body (204), hinge member (208) lever (220) may be integrally coupled such that highlight application (200) is substantially one piece. It should be understood, that any orientation or configuration of bristles discussed herein could be incorporated within flexible bristle member (110,210) during the integral coupling process. The examples discussed above should not be considered limiting, any combination of components of highlight applicator (200) may be integrally coupled, and such couplings will be apparent to those of ordinary skill in the art in view of the teachings herein.

As discussed above, flexible bristle member (210) may be coupled integrally with body (204) among other components. Unlike flexible bristle member (110), which is deformed from it original predetermined shape to one having an exterior convex shape after assembly, flexible bristle member (210) maintains its original shape until operation. Because flexible member (210) will maintain its shape until operation, bristles (114) will as well. Therefore, as shown in FIGS. 21-22, bristles may be oriented in a substantially vertical orientation and will remain as such until operation. Thus, substantially vertical orientation of bristles (114) as shown in FIGS. 23A-23B, compared to an angled orientation of bristles (114) as shown in FIGS. 24A-24B, require less effort by the user to bring the bristles (114) to a closed position. This is because less deformation of flexible bristle member (210) is necessary to bring bristles (114) to a closed position.

Figure 36:
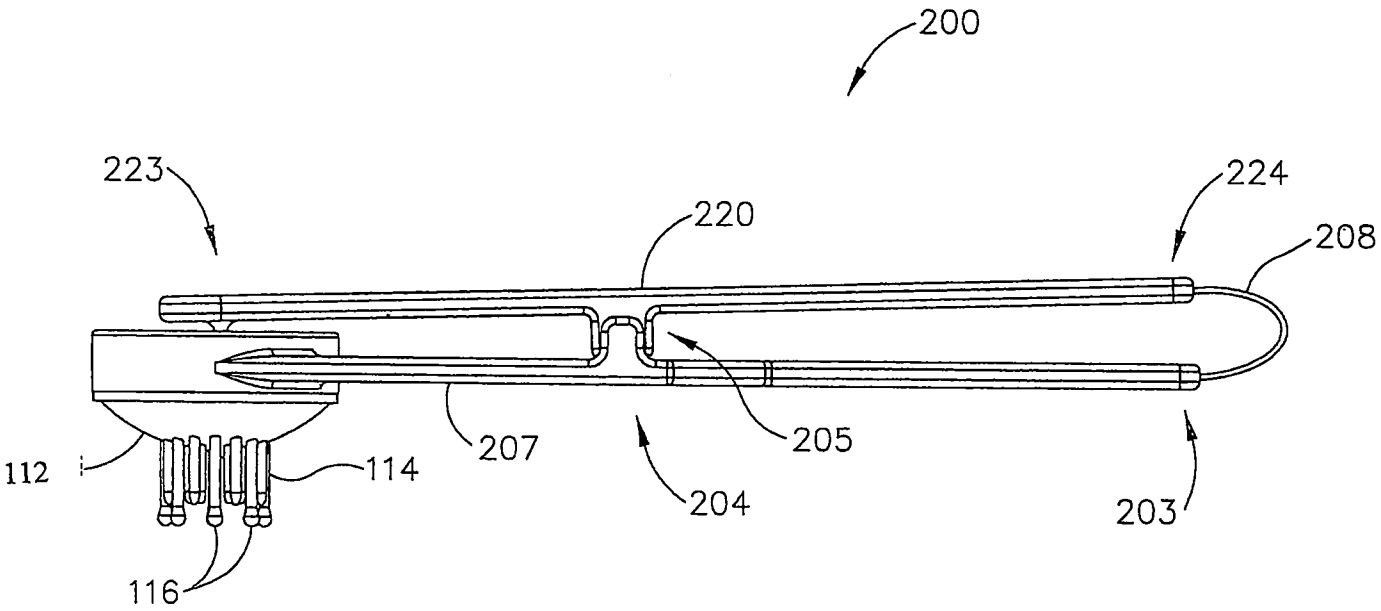
FIG. 36 depicts a cross-sectional side view of a highlight applicator showing exemplary positioning of a hinge member.

As seen in FIG. 19, prior to assembly, hinge member (208) is substantially flat, and lever (220) is substantially parallel to a handle portion (207) of body (204). During assembly however, lever (220) is coupled to a pivot member (205)—about which lever (220) is pivotable—and hinge member (208) becomes deformed to a first position as shown in FIG. 20. (Pivot member (205) is an integral portion of body (204).) It should be understood that pivot member (205) may be positioned at any appropriate point along handle portion (207) of body (204). It should also be understood that pivot member (205) may be positioned such that proximal end (223) of lever (220) is in a position above body (204) as shown in FIG. 36, or alternatively pivot member (205) may be positioned such that proximal end (223) of lever (220) is in a position within body (204) as shown in FIG. 20.) In this first position, hinge member (208) exerts an upward bias on distal end (224) of lever (220) in an effort to return to hinge member's (208) original substantially flat shape. The upward bias created by the hinge member (208) is counteracted by a resistant force transferred from flexible bristle member (110) through a flexible connector (not shown) to proximal end (223) of lever (220). (The flexible connector may be for example, a flexible rod or a spring.) This resistant force is caused by the inability of flexible bristle member (110) to be deformed downward further. Balancing of the upward bias created by the hinge member (208) and the resistant force created by the flexible bristle member (110) causes lever (220) to remain substantially stationary after assembly. When in use, however, a user may operate lever (220) by causing lever (220) to pivot about pivot about pivot member (205). Such an operation will cause proximal end (223) of lever (220) to move upward thereby lifting the center of flexible bristle member (110) and manipulating the positioning of bristle tips (116) relative to each other. Operation of lever (220) will also cause distal end (224) of lever (220) to move downward towards handle portion (207) of body (204). Such downward movement will further deform hinge member (208) to a second position. In this second position, hinge member (208) will continue to exert an upward bias on distal end (224) of lever (220) in an effort to return to hinge member's (208) original substantially flat shape. Once the user releases lever (220) this upward bias created by hinge member (208) will cause hinge member (208), and as a result lever (220), to return to the first position, wherein the forces being exerted upon proximal end (223) and distal end (224) of lever (220) are balanced as discussed above.

In some versions of highlight applicator (200), body (204) may comprise a lever stop (240) as shown in FIGS. 21-22. In the present example, lever stop (240) is defined by an opening in body (204) through which proximal end (223) of lever (220) extends. During operation, as lever (220) is pivoted about pivot member (205), proximal end (223) is raised to draw up flexible member (110) as discussed above. A top edge of (242) lever stop may provide an upper limit to which proximal end (223) of lever (220) may travel. A bottom edge (244) may provide a lower limit to which proximal end (223) of lever (220) may travel. Such limits on travel of proximal end (223) of lever (220) will limit the extent to which bristles (114) of flexible bristle member (110) may be opened or closed. It should be understood that in some versions of highlight applicator (200) limitation on travel of proximal end (223) of lever (220) may be provided by top edge (242) of lever stop (240) exclusively, while in other versions limitation on travel of proximal end (223) of lever (220) may be provided by bottom edge (244) of lever stop (240) exclusively, and in others limitation on travel of proximal end (223) of lever (220) may be provided by top edge (242) and bottom edge (244) of lever stop (240) concurrently. For instance, in some versions of highlight applicator (200) top edge (242) of lever stop (240) may be utilized as an upper limit while the lower limit of travel of proximal end (223) of lever (220) is provided by flexible bristle member (110) as discussed above. Although lever stop (240) of the present example is defined by an opening in body (204), other embodiments of lever stop (240) will be apparent to those of ordinary skill in the art in view of the teachings herein. For example, a lever stop may be provided by an inwardly extending tab or tabs within the interior circumference of body (204).

Figure 25:
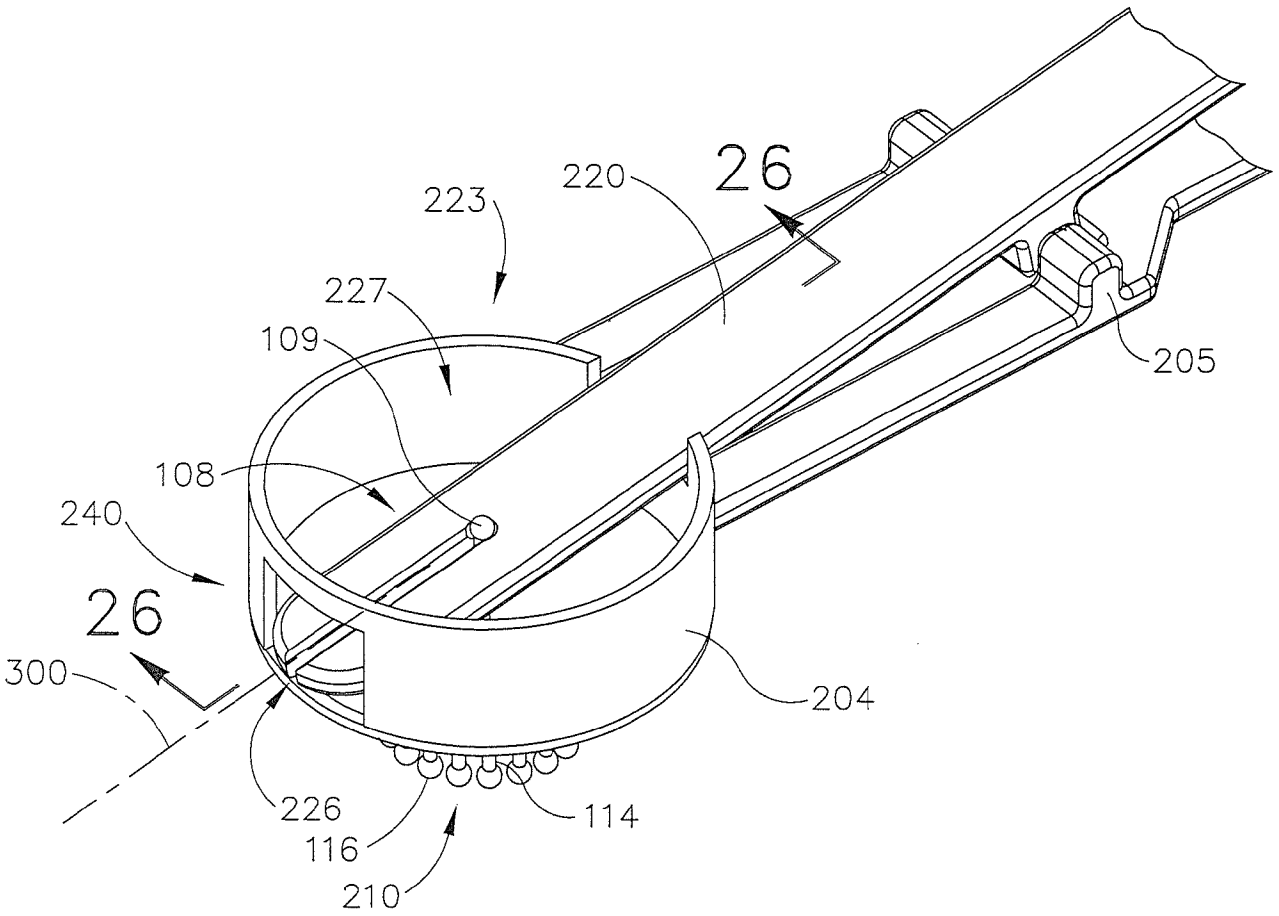
FIG. 25 depicts a perspective view of an exemplary alternative lever of the alternative highlight applicator of FIG. 19.
Figure 26:
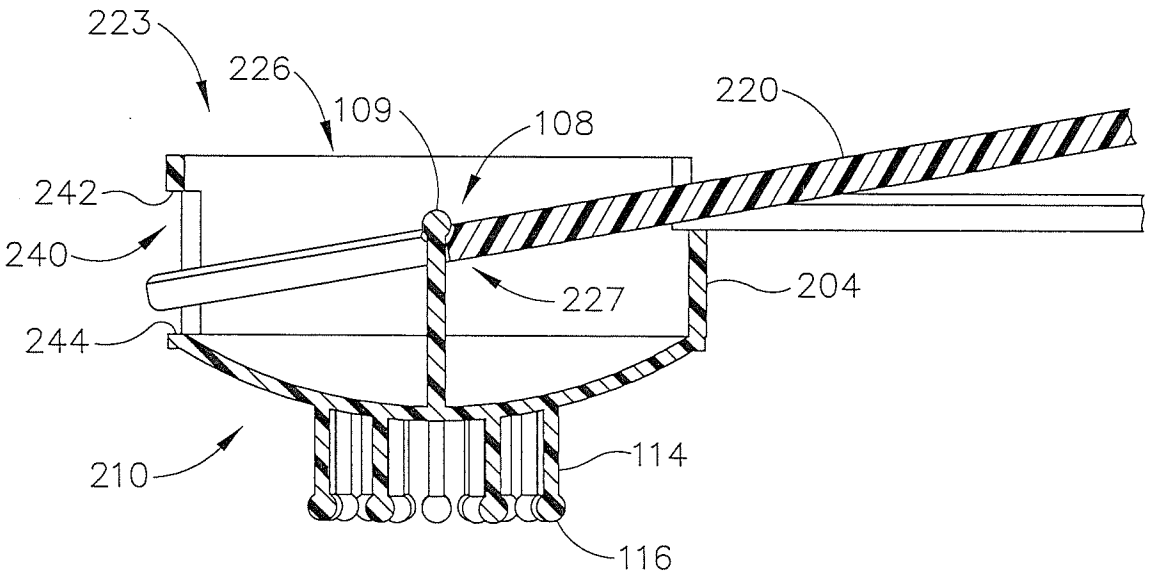
FIG. 26 depicts a cross-sectional side view, taken along line 26-26 of FIG. 25, of the alternative level of FIG. 25.

In some versions of highlight application (200), lever (220) may comprise a slot (226). As shown in FIGS. 25-26, slot (226) is formed in proximal end (223) of level (220). As best seen in FIG. 26, slot (226) comprises a recess (227). Slot (226) is configured to receive tip (109) of flexible connector (108) during assembly. Recess (227) is configured to receive tip (109) of flexible connector (108) and prevent decoupling of flexible connector (108) from lever (220). The downwardly directed bias exerted upon proximal end (223) of lever (220) by the deformation of flexible bristle member (110) as discussed above will help to ensure that tip (109) of flexible connector (108) remains in recess (227) during operation. As shown in FIG. 25, slot (226) is formed in lever (220) along a longitudinal axis (300) defined by lever (220). In other versions, slot (226) may be formed in lever (220) transverse to longitudinal axis (300). Still other embodiments of slot (226) will be apparent to those of ordinary skill in the art in view of the teachings herein.

IV. Exemplary Alternative Multi-Phase Bristle Members

FIGS. 27A-29B depict three exemplary alternative discs (302, 312, 322). It should be understood that discs (302, 312, 322) may be utilized by highlight applicator (100) and/or highlight applicator (200), and that discs (302, 312, 322) may be combined with any orientation of bristles as discussed above. It should also be understood that, except for the differences discussed below, discs (302, 312, 322) are configured to operate and function substantially similar to disc (112) as discussed above.

Discs (302, 312, 322) may, among other things, provide for increased accuracy and control when applying a hair coloration product to a user's hair. This is because, among other things, discs (302, 312, 322) may be utilized to create a multiple phase grasping of the user's hair. As will be discussed below, discs (302, 312, 322) comprise features which cause a center portion (306, 316, 326) of discs (302, 312, 322) to be drawn upward at a different rate and/or at a different time than the rest of the discs (302, 312, 322). This will cause a plurality of bristles (304, 314, 324) to deform at different rates or at different times depending upon the orientation and location of the bristles (304, 314, 324) on the discs (302, 312, 322) in relation to these features. The bristle orientation shown in FIGS. 8A-8C may be utilized with discs (302, 312, 322) and may be oriented such that the inner ring of bristles is located on or near the center portion of discs (302, 312, 322) in order to cause this inner ring of bristles to be manipulated prior to an outer ring of bristles. This is because, as previously stated, the center portion of discs (302, 312, 322) may be drawn upward at a different rate and/or at a different time than the rest of the discs (302, 312, 322).

Figure 27A:
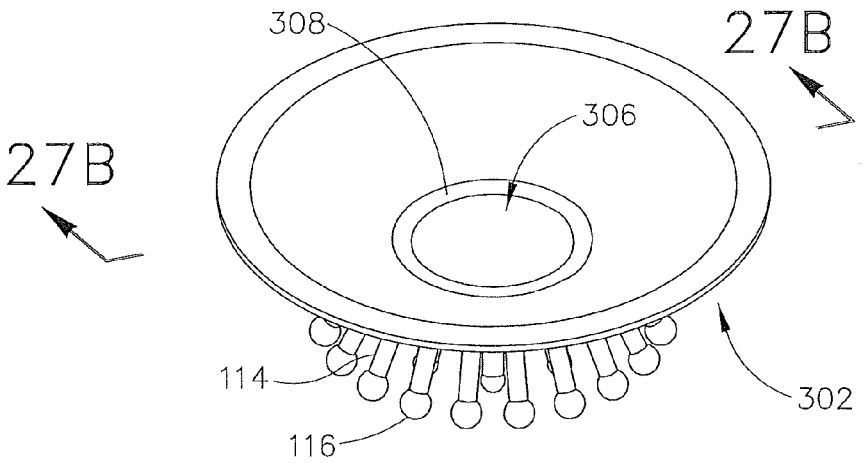
FIG. 27A depicts a perspective view of an exemplary alternative disc of a flexible bristle member.
Figure 27B:
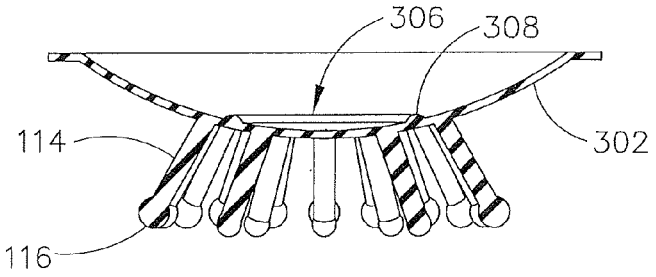
FIG. 27B depicts a cross-sectional side view, taken along line 27B-27B of FIG. 27A, of the disc of FIG. 27A.

As shown in FIGS. 27A and 27B, disc (302) comprises a circular center portion (306). Center portion (306) is defined by an outer ring (308) protruding from an inner surface of disc (302). As best seen in FIG. 27B, when assembled, a cross-sectional profile of center portion (306) is defined by an ellipse having substantially similar major and minor axes as an ellipse defining the rest of the disc (302). Center portion (306) may be comprised of material having the same thickness as the rest of disc (302), or may be comprised of a material having a different thickness than the rest of the disc (302).

Figure 28A:
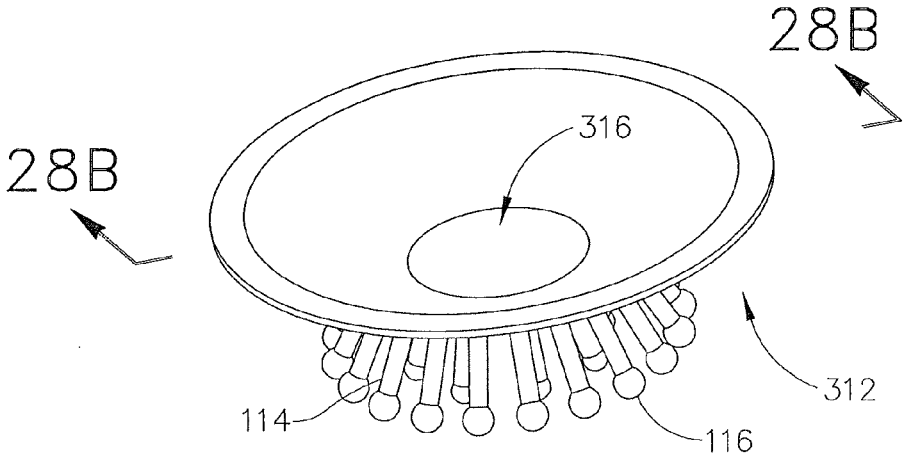
FIG. 28A depicts a perspective view of another exemplary alternative disc of a flexible bristle member.
Figure 28B:
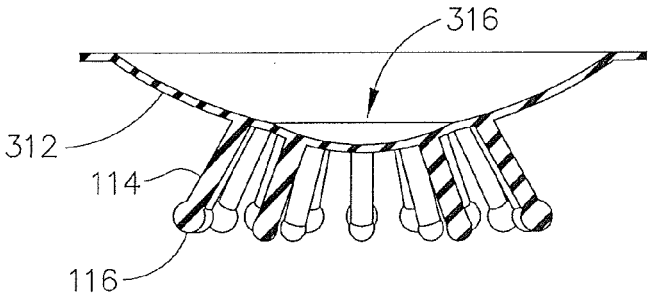
FIG. 28B depicts a cross-sectional side view, taken along line 28B-28B of FIG. 28A, of the disc of FIG. 28A.

As shown in FIGS. 28A and 28B, disc (312) comprises a raised circular center portion (316). Raised center portion (316) protrudes from the center of disc (312). As best seen in FIG. 28B, when assembled, a cross-sectional profile of raised center portion (316) is defined by an ellipse having a substantially different major and minor axes as an ellipse defining the rest of the disc (312). Raised center portion (316) may be comprised of material having the same thickness as the rest of disc (312), or may be comprised of a material having a different thickness than the rest of disc (312).

Figure 29A:
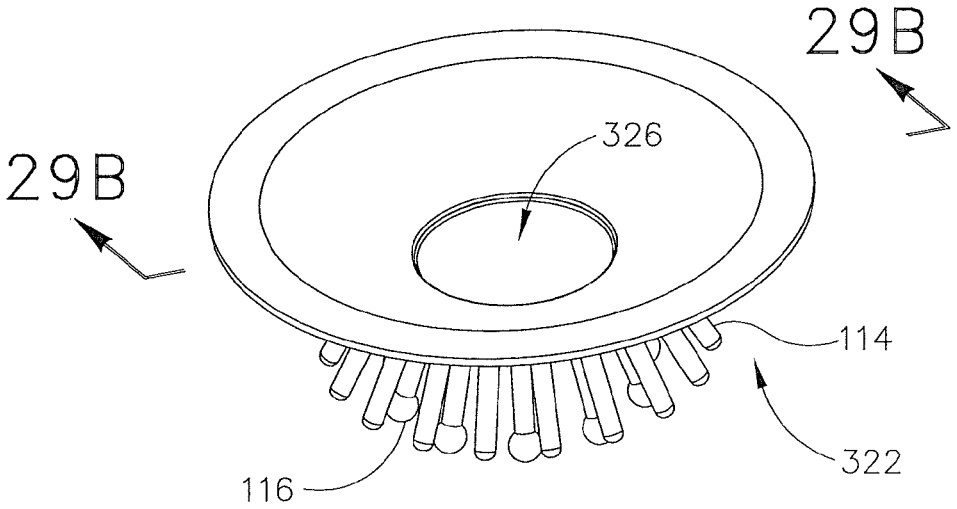
FIG. 29A depicts a perspective view of another exemplary alternative disc of a flexible bristle member.
Figure 29B:
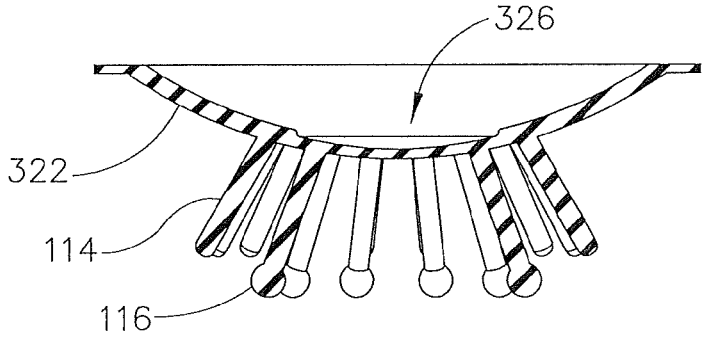
FIG. 29B depicts a cross-sectional side view, taken along line 29B-29B of FIG. 29A, of the disc of FIG. 29A.

As shown in FIGS. 29A and 29B, disc (322) comprises a circular center portion (326). Center portion (326) is at the center of disc (322) and has a different thickness that the rest of disk (322). As best seen in FIG. 29B, when assembled, a cross-sectional profile of center portion (326) is defined by an ellipse having substantially similar major and minor axes as an ellipse defining the rest of the disc (322).

V. Exemplary Alternative Flat Bristle Member

Figure 30A:
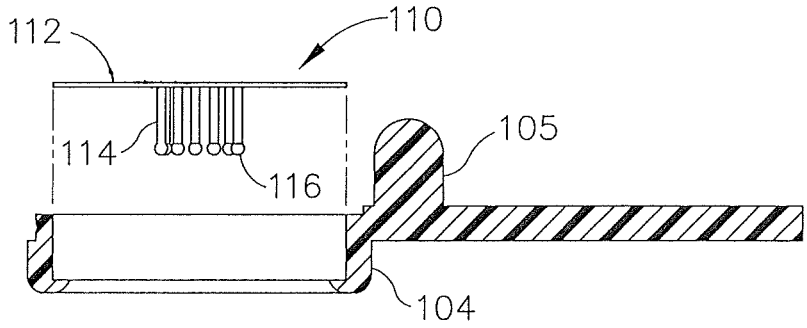
FIG. 30A depicts a cross-sectional side view of a flexible bristle member having a flat disc being inserted into the exemplary highlight applicator of FIG. 1.
Figure 30B:
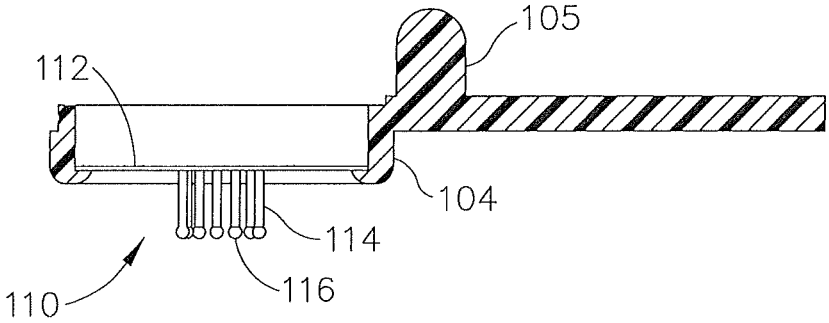
FIG. 30B depicts a cross-sectional side view of the flexible bristle member of FIG. 30A having been inserted into the exemplary highlight applicator of FIG. 1.
Figure 30C:
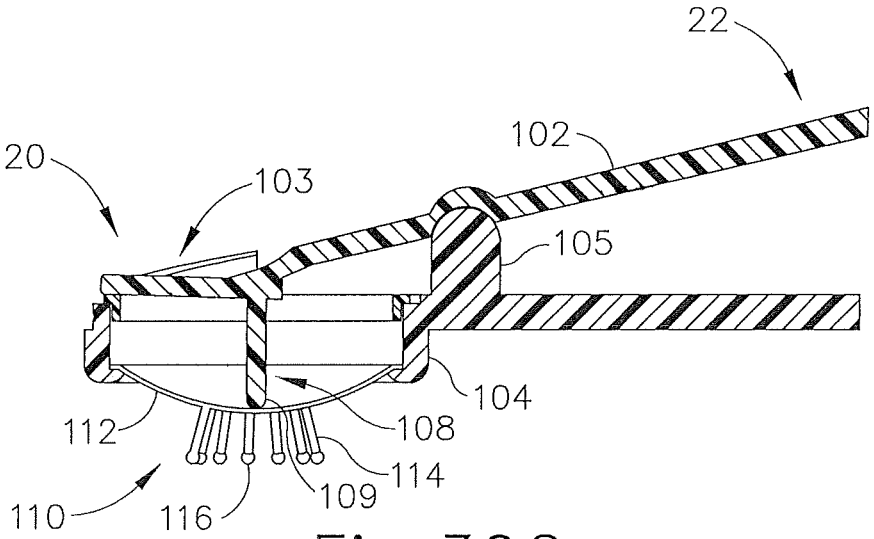
FIG. 30C depicts a cross-sectional side view of the flexible bristle member of FIG. 30A having been inserted into the exemplary highlight applicator of FIG. 1 and coupled with a lever.

As discussed above, flexible bristle member (110) is configured to create a frictional seal between the exterior circumference of flexible bristle member (110) and an interior circumference of body (104) which causes flexible bristle member (110) to deform from its original substantially flat shape to one having an exterior convex shape when assembled, as shown in FIG. 2A. Alternatively, a flat disc (332) may be utilized instead of disc (112). As shown in FIGS. 30A-30C, flat disc (332) is configured to remain substantially flat after assembly. This is because flat disc (332) has a substantially similar or slightly smaller overall diameter than the interior circumference of body (104) so that little or no force is exerted on the interior circumference body (104). Such a configuration causes disc (332) to remain substantially flat when assembled, as shown in FIG. 30B. Flat disc (332) will only become deformed after an external force (for example, a force from the operator or spring (150) among others), acting through lever (102), exerts a force from upon the center of flat disc (332) via flexible connector (108) as shown in FIG. 30C. It should be understood that flat disc (332) may be utilized by highlight applicator (100) and/or highlight applicator (200), and that flat disc (332) may be combined with any orientation of bristles as discussed above. It should also be understood, that any of the multi-phase features discussed above may be utilized with flat disc (332).

CONCLUSION

Although exemplary highlight applicators (100, 200) may be used, as discussed above, to apply hair coloring compositions such as highlighting and dyeing products, it should be understood that exemplary highlight applicators (100, 200) may be used to apply any of a number of hair coloring or bleaching compositions, for example a suspension, an emulsion, a viscous solution, a gel, a lotion, a foam, or a cream hair coloring or dyeing product to a user's hair. Such other hair products which may be applied using exemplary highlight applicators (100, 200) include: hair conditioning products, hair repair products, and/or hair styling products, in addition to hair coloring compositions as discussed above. Furthermore, it is understood that the applicator of the present invention can be applied not only as a hair "highlighter" but also as a "low lighter" or other means for applying partial color or dye to the hair. Finally, another embodiment of the present invention includes a kit for partial coloring of hair, comprising the applicator assembly and a hair coloring composition.

Although the use of highlight applicators (100, 200) has been discussed in reference to the coloring of hair, it should be understood, that highlight applicators (100, 200) may be used with any appropriate hair product, for example, a hair conditioning or a hair styling product among others.

What is claimed is:

1. An applicator assembly, wherein the applicator assembly comprises:

(a) a body;

(b) a partially spherical flexible member, wherein the flexible member comprises a plurality of bristles extending distally from an exterior convex surface of the flexible member, and wherein the flexible member is disposed within the body; and (c) a transfer member, wherein the transfer member is operable to transfer a center of the flexible member along a longitudinal axis of the body, and wherein transferring of the center of the flexible member causes the plurality of bristles to close, and wherein the transfer member comprises a lever, and wherein the lever is coupled to the center of the flexible member at a proximal end of the lever.

2. The applicator assembly of claim 1, wherein the body comprises an opening, wherein the proximal end of the lever extends through the opening, and wherein the opening is configured to limit movement of the lever.

3. The applicator assembly of claim 1, wherein the lever comprises a slot at the proximal end of the lever, and wherein the slot is configured to receive the transfer member.

4. The applicator assembly of claim 1, wherein the body comprises a handle portion having a distal end, wherein the lever comprises a distal end, wherein the applicator assembly further comprises a hinge member, and wherein the hinge member is coupled to the distal end of the handle portion of the body and the distal end of the lever.

5. The applicator assembly of claim 4, wherein the body, the hinge member, and the lever are one piece.

6. The applicator assembly of claim 4, wherein the body, the hinge member, the lever, and the flexible member are one piece.

7. The applicator assembly of claim 1, wherein the flexible member is configured such that it exerts an initial downward bias upon the proximal end of the lever.

8. The applicator assembly of claim 1, wherein the transfer member comprises a spring.

9. The applicator assembly of claim 1, further comprising an adjustment member in contact with the flexible member configured to adjust an initial position of the center of the flexible member.

10. The applicator assembly of claim 9, wherein the adjustment member comprises a rotatable ramp.

11. The applicator assembly of claim 1, wherein the plurality of bristles comprises bristles of at least two different lengths.

12. The applicator assembly of claim 1, wherein each bristle of the plurality of bristles comprises a spherical tip.

13. The applicator assembly of claim 1, wherein the bristles of the plurality of bristles are arranged in a circular pattern around the center of the flexible member.

14. The applicator assembly of claim 13, wherein the circular pattern of bristles comprises bristles of different lengths.

15. The applicator assembly of claim 1, wherein the bristles of the plurality of bristles are arranged in at least two circular patterns, and wherein the circular patterns are different radial distances from the center of the flexible member.

16. The applicator assembly of claim 15, wherein the circular patterns of the at least two circular patterns comprise bristles of different lengths.

17. The applicator assembly of claim 1, wherein the bristles of the plurality of bristles are arranged such that the bristles present an inner circular pattern and an outer elliptical pattern.

18. The applicator assembly of claim 17 wherein the inner circular pattern and the outer elliptical pattern comprise bristles of different lengths.

19. A method for dyeing hair using a hair applicator as defined in claim 1, the method comprising:

(a) applying a hair coloring composition on a surface of the flexible member at an area surrounded by the plurality of bristles;

(b) transferring the flexible member from a forward distal position to a proximal position to cause the plurality of bristles to change position thereby grasping a strand of hair at the root of the hair; and (c) combing the hair coloring composition throughout the strand of hair by moving the hair applicator from the root of the hair to the end of the hair.

20. The method of claim 19, wherein the hair coloring composition is selected from the group consisting of: a suspension, an emulsion, a viscous solution, a gel, a lotion, a foam, and a cream.

21. The method of claim 19, further comprising the step of transferring the flexible member from a proximal position to a forward distal position to open the bristles prior to the step of applying a hair coloring composition on a surface of the flexible member.

22. A method for dyeing hair using a hair applicator as defined in claim 1, the method comprising:

(a) adjusting the initial position of the center of the flexible member to pre-set a width of the bristle tips;

(b) applying a hair coloring composition on a surface of the flexible member at an area surrounded by the plurality of bristles;

(c) transferring the flexible member from a forward distal position to a proximal position to cause the plurality of bristles to change position thereby grasping a strand of hair at the root of the hair; and (d) combing the hair coloring composition throughout the strand of hair by moving the hair applicator from the root of the hair to the end of the hair.

23. A method for dyeing hair using a hair applicator as defined in claim 1, the method comprising:

(a) applying a hair coloring composition on a surface of the flexible member at an area surrounded by the plurality of bristles;

(b) transferring the flexible member from a forward distal position to a proximal position to cause the plurality of bristles to change position thereby grasping a strand of hair at the root of the hair;

(c) grasping a section of hair within the bristles of the hair applicator;

(d) attaching a clip to the section of hair; and (e) repeating the steps of grasping a section of hair and attaching a clip to the section of hair as many times as desired.

24. A kit for partial coloring of hair, the kit comprising the applicator assembly of claim 1, and a hair coloring composition.

25. An applicator assembly, wherein the applicator assembly comprises:

(a) a body;

(b) a partially spherical flexible member, wherein the flexible member comprises a plurality of bristles extending distally from an exterior convex surface of the flexible member, and wherein the flexible member is dispersed within the body, and there is an area surrounded by the bristles on the flexible member for holding a hair coloring composition; and (c) a transfer member, wherein the transfer member is operable to transfer a center of the flexible member along a longitudinal axis of the body, and wherein transferring the center of the flexible member causes the plurality of bristles to close, such that the applicator enables the bristles to be closed as part of the process of brushing hair.

* * * * *